US008294635B2

(12) United States Patent
Origuchi et al.

(10) Patent No.: US 8,294,635 B2
(45) Date of Patent: Oct. 23, 2012

(54) PLASMA DISPLAY DEVICE AND DRIVING METHOD OF PLASMA DISPLAY PANEL

(75) Inventors: Takahiko Origuchi, Osaka (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 419 days.

(21) Appl. No.: 12/443,828

(22) PCT Filed: Jan. 10, 2008

(86) PCT No.: PCT/JP2008/050162

§ 371 (c)(1),
(2), (4) Date: Apr. 1, 2009

(87) PCT Pub. No.: WO2008/084819

PCT Pub. Date: Jul. 17, 2008

(65) Prior Publication Data

US 2010/0033459 A1 Feb. 11, 2010

(30) Foreign Application Priority Data

Jan. 12, 2007 (JP) ..... 2007-004155

(51) Int. Cl.
*G09G 3/28* (2006.01)

(52) U.S. Cl. ..... 345/60; 345/63

(58) Field of Classification Search ..... 345/211, 345/60–72

See application file for complete search history.

(56) References Cited

U.S. PATENT DOCUMENTS

| | | | |
|---|---|---|---|
| 6,448,960 | B1 | 9/2002 | Shigeta |
| 7,511,685 | B2 | 3/2009 | Kim |
| 2005/0264230 | A1 | 12/2005 | Kim |
| 2006/0033680 | A1 | 2/2006 | Choi |
| 2006/0033682 | A1 | 2/2006 | Choi |
| 2006/0187147 | A1 | 8/2006 | Jeong |
| 2007/0252784 | A1 | 11/2007 | Maeda |
| 2007/0262921 | A1 | 11/2007 | Horie |
| 2009/0091514 | A1 | 4/2009 | Origuchi |
| 2009/0122042 | A1 | 5/2009 | Origuchi |
| 2009/0167642 | A1 | 7/2009 | Kim |
| 2009/0231317 | A1 | 9/2009 | Origuchi |

FOREIGN PATENT DOCUMENTS

| | | | |
|---|---|---|---|
| CN | 1825409 | A | 8/2006 |
| CN | 2010090600421910 | | 9/2010 |
| EP | 1 696 409 | A2 | 8/2006 |
| EP | 08 70 3033 | | 12/2009 |
| JP | 11305726 | A | 11/1999 |
| JP | 2000-242224 | A | 9/2000 |

(Continued)

*Primary Examiner* — Alexander Eisen
*Assistant Examiner* — Robin Mishler
(74) *Attorney, Agent, or Firm* — RatnerPrestia

(57) ABSTRACT

A stable address discharge is generated and number of unlit cells is decreased without heightening the voltage necessary for generating an address discharge. For this purpose, the device includes a plasma display panel and a driving circuit for driving the plasma display panel, in which the driving circuit drives the plasma display panel having a sub-field group formed of two or more continuous sub-fields for controlling addressing provided in one field period, so as not to generate sustain discharge in the discharge cell not causing sustain discharge and also in the subsequent sub-fields, the discharge cell is initialized by applying a ramp waveform voltage descending gently to the scan electrode, the lowest voltage of the ramp waveform voltage of the sub-field included in the sub-field group is made different from the lowest voltage of the ramp waveform voltage of the sub-field not included in the sub-field group.

2 Claims, 20 Drawing Sheets

FOREIGN PATENT DOCUMENTS

| | | | |
|---|---|---|---|
| JP | 2002-023692 | A | 1/2002 |
| JP | 2005196193 | A | 7/2005 |
| JP | 200653564 | A | 2/2006 |
| JP | 2006-235598 | A | 9/2006 |
| JP | 2006235598 | A | 9/2006 |
| JP | 2006293112 | A | 10/2006 |
| JP | 2006293113 | A | 10/2006 |
| JP | 2007-078946 | A | 3/2007 |
| JP | 2007333840 | A | 12/2007 |
| JP | 4530047 | B2 | 8/2010 |
| JP | 4655090 | B2 | 3/2011 |
| JP | 4655150 | B2 | 3/2011 |
| KR | 10-2009-7013838 | | 12/2010 |
| WO | WO 2006/112345 | A1 | 10/2006 |
| WO | WO 2006/112346 | A1 | 10/2006 |
| WO | WO 2007/099903 | A1 | 9/2007 |
| WO | PCT/JP2008/050162 | | 2/2008 |

FIG. 5A

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 0 | | | | | | | | | | |
| 1 | 1 | | | | | | | | | |
| 2 | | 1 | | | | | | | | |
| 3 | 1 | 1 | | | | | | | | |
| 4 | 1 | | 1 | | | | | | | |
| 5 | | 1 | 1 | | | | | | | |
| 6 | 1 | 1 | 1 | | | | | | | |
| 8 | | 1 | | 1 | | | | | | |
| 9 | 1 | 1 | | 1 | | | | | | |
| 10 | 1 | | 1 | 1 | | | | | | |
| 11 | | 1 | 1 | 1 | | | | | | |
| 12 | 1 | 1 | 1 | 1 | | | | | | |
| 17 | | 1 | 1 | | 1 | | | | | |
| 18 | 1 | 1 | 1 | | 1 | | | | | |
| 20 | | 1 | | 1 | 1 | | | | | |
| 21 | 1 | 1 | | 1 | 1 | | | | | |
| 22 | 1 | | 1 | 1 | 1 | | | | | |
| 23 | | 1 | 1 | 1 | 1 | | | | | |
| 24 | 1 | 1 | 1 | 1 | 1 | | | | | |
| 33 | | 1 | 1 | 1 | | 1 | | | | |
| 34 | 1 | 1 | 1 | 1 | | 1 | | | | |
| 39 | | 1 | 1 | | 1 | 1 | | | | |
| 40 | 1 | 1 | 1 | | 1 | 1 | | | | |
| 42 | | 1 | | 1 | 1 | 1 | | | | |
| 43 | 1 | 1 | | 1 | 1 | 1 | | | | |
| 44 | 1 | | 1 | 1 | 1 | 1 | | | | |

FIG. 5B

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 45 | | 1 | 1 | 1 | 1 | 1 | | | | |
| 46 | 1 | 1 | 1 | 1 | 1 | 1 | | | | |
| 60 | | 1 | 1 | 1 | 1 | | 1 | | | |
| 61 | 1 | 1 | 1 | 1 | 1 | | 1 | | | |
| 70 | | 1 | 1 | 1 | | 1 | 1 | | | |
| 71 | 1 | 1 | 1 | 1 | | 1 | 1 | | | |
| 76 | | 1 | 1 | | 1 | 1 | 1 | | | |
| 77 | 1 | 1 | 1 | | 1 | 1 | 1 | | | |
| 79 | | 1 | | 1 | 1 | 1 | 1 | | | |
| 80 | 1 | 1 | | 1 | 1 | 1 | 1 | | | |
| 81 | 1 | | 1 | 1 | 1 | 1 | 1 | | | |
| 82 | | 1 | 1 | 1 | 1 | 1 | 1 | | | |
| 83 | 1 | 1 | 1 | 1 | 1 | 1 | 1 | | | |
| 105 | | 1 | 1 | 1 | 1 | | 1 | 1 | | |
| 106 | 1 | 1 | 1 | 1 | 1 | | 1 | 1 | | |
| 115 | | 1 | 1 | 1 | | 1 | 1 | 1 | | |
| 116 | 1 | 1 | 1 | 1 | | 1 | 1 | 1 | | |
| 121 | | 1 | 1 | | 1 | 1 | 1 | 1 | | |
| 122 | 1 | 1 | 1 | | 1 | 1 | 1 | 1 | | |
| 124 | | 1 | | 1 | 1 | 1 | 1 | 1 | | |
| 125 | 1 | 1 | | 1 | 1 | 1 | 1 | 1 | | |
| 126 | 1 | | 1 | 1 | 1 | 1 | 1 | 1 | | |
| 127 | | 1 | 1 | 1 | 1 | 1 | 1 | 1 | | |
| 128 | 1 | 1 | 1 | 1 | 1 | 1 | 1 | 1 | | |
| 162 | | 1 | 1 | 1 | 1 | | 1 | 1 | 1 | |
| 163 | 1 | 1 | 1 | 1 | 1 | | 1 | 1 | 1 | |
| 172 | | 1 | 1 | 1 | | 1 | 1 | 1 | 1 | |

FIG. 5C

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 173 | 1 | 1 | 1 | 1 | | 1 | 1 | 1 | 1 | |
| 178 | | 1 | 1 | | 1 | 1 | 1 | 1 | 1 | |
| 179 | 1 | 1 | 1 | | 1 | 1 | 1 | 1 | 1 | |
| 181 | | 1 | | 1 | 1 | 1 | 1 | 1 | 1 | |
| 182 | 1 | 1 | | 1 | 1 | 1 | 1 | 1 | 1 | |
| 183 | 1 | | 1 | 1 | 1 | 1 | 1 | 1 | 1 | |
| 184 | | 1 | 1 | 1 | 1 | 1 | 1 | 1 | 1 | |
| 185 | 1 | 1 | 1 | 1 | 1 | 1 | 1 | 1 | 1 | |
| 233 | | 1 | 1 | 1 | 1 | | 1 | 1 | 1 | 1 |
| 234 | 1 | 1 | 1 | 1 | 1 | | 1 | 1 | 1 | 1 |
| 243 | | 1 | 1 | 1 | | 1 | 1 | 1 | 1 | 1 |
| 244 | 1 | 1 | 1 | 1 | | 1 | 1 | 1 | 1 | 1 |
| 249 | | 1 | 1 | | 1 | 1 | 1 | 1 | 1 | 1 |
| 250 | 1 | 1 | 1 | | 1 | 1 | 1 | 1 | 1 | 1 |
| 252 | | 1 | | 1 | 1 | 1 | 1 | 1 | 1 | 1 |
| 253 | 1 | 1 | | 1 | 1 | 1 | 1 | 1 | 1 | 1 |
| 254 | 1 | | 1 | 1 | 1 | 1 | 1 | 1 | 1 | 1 |
| 255 | | 1 | 1 | 1 | 1 | 1 | 1 | 1 | 1 | 1 |
| 256 | 1 | 1 | 1 | 1 | 1 | 1 | 1 | 1 | 1 | 1 |

FIG. 6A

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 0 | | | | | | | | | | |
| 1 | 1 | | | | | | | | | |
| 2 | | 1 | | | | | | | | |
| 3 | 1 | 1 | | | | | | | | |
| 4 | 1 | | 1 | | | | | | | |
| 5 | | 1 | 1 | | | | | | | |
| 6 | 1 | 1 | 1 | | | | | | | |
| 7 | 1 | | | 1 | | | | | | |
| 8 | | 1 | | 1 | | | | | | |
| 9 | 1 | 1 | | 1 | | | | | | |
| 10 | 1 | | 1 | 1 | | | | | | |
| 11 | | 1 | 1 | 1 | | | | | | |
| 12 | 1 | 1 | 1 | 1 | | | | | | |
| 13 | 1 | | | | 1 | | | | | |
| 14 | | 1 | | | 1 | | | | | |
| 57 | | 1 | | 1 | 1 | | 1 | | | |
| 58 | 1 | 1 | | 1 | 1 | | 1 | | | |
| 59 | | | 1 | 1 | 1 | | 1 | | | |
| 60 | | 1 | 1 | 1 | 1 | | 1 | | | |
| 61 | 1 | 1 | 1 | 1 | 1 | | 1 | | | |
| 62 | 1 | 1 | | | | 1 | 1 | | | |
| 63 | 1 | | 1 | | | 1 | 1 | | | |
| 64 | | 1 | 1 | | | 1 | 1 | | | |
| 65 | 1 | 1 | 1 | | | 1 | 1 | | | |
| 66 | 1 | | | 1 | | 1 | 1 | | | |
| 67 | | 1 | | 1 | | 1 | 1 | | | |
| 68 | 1 | 1 | | 1 | | 1 | 1 | | | |
| 69 | 1 | | 1 | 1 | | 1 | 1 | | | |
| 70 | | 1 | 1 | 1 | | 1 | 1 | | | |
| 71 | 1 | 1 | 1 | 1 | | 1 | 1 | | | |

FIG. 6B

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 127 | | 1 | 1 | 1 | 1 | 1 | 1 | 1 | | |
| 128 | 1 | 1 | 1 | 1 | 1 | 1 | 1 | 1 | | |
| 129 | 1 | | | | 1 | 1 | 1 | | 1 | |
| 130 | | 1 | | | 1 | 1 | 1 | | 1 | |
| 131 | 1 | 1 | | | 1 | 1 | 1 | | 1 | |
| 132 | 1 | | 1 | | 1 | 1 | 1 | | 1 | |
| 133 | | 1 | 1 | | 1 | 1 | 1 | | 1 | |
| 134 | 1 | 1 | 1 | | 1 | 1 | 1 | | 1 | |
| 135 | 1 | | | 1 | 1 | 1 | 1 | | 1 | |
| 136 | | 1 | | 1 | 1 | 1 | 1 | | 1 | |
| 137 | 1 | 1 | | 1 | 1 | 1 | 1 | | 1 | |
| 138 | 1 | | 1 | 1 | 1 | 1 | 1 | | 1 | |
| 139 | | 1 | 1 | 1 | 1 | 1 | 1 | | 1 | |
| 140 | 1 | 1 | 1 | 1 | 1 | 1 | 1 | | 1 | |
| 141 | | 1 | 1 | | 1 | 1 | | 1 | 1 | |
| 142 | 1 | 1 | 1 | | 1 | 1 | | 1 | 1 | |
| 245 | 1 | | | | 1 | 1 | 1 | 1 | 1 | 1 |
| 246 | | 1 | | | 1 | 1 | 1 | 1 | 1 | 1 |
| 247 | 1 | 1 | | | 1 | 1 | 1 | 1 | 1 | 1 |
| 248 | 1 | | 1 | | 1 | 1 | 1 | 1 | 1 | 1 |
| 249 | | 1 | 1 | | 1 | 1 | 1 | 1 | 1 | 1 |
| 250 | 1 | 1 | 1 | | 1 | 1 | 1 | 1 | 1 | 1 |
| 251 | 1 | | | 1 | 1 | 1 | 1 | 1 | 1 | 1 |
| 252 | | 1 | | 1 | 1 | 1 | 1 | 1 | 1 | 1 |
| 253 | 1 | 1 | | 1 | 1 | 1 | 1 | 1 | 1 | 1 |
| 254 | 1 | | 1 | 1 | 1 | 1 | 1 | 1 | 1 | 1 |
| 255 | | 1 | 1 | 1 | 1 | 1 | 1 | 1 | 1 | 1 |
| 256 | 1 | 1 | 1 | 1 | 1 | 1 | 1 | 1 | 1 | 1 |

FIG. 15A

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 0 | | | | | | | | | | |
| 1 | 1 | | | | | | | | | |
| 2 | | 1 | | | | | | | | |
| 3 | 1 | 1 | | | | | | | | |
| 4 | 1 | | 1 | | | | | | | |
| 5 | | 1 | 1 | | | | | | | |
| 6 | 1 | 1 | 1 | | | | | | | |
| 8 | | 1 | | 1 | | | | | | |
| 9 | 1 | 1 | | 1 | | | | | | |
| 10 | 1 | | 1 | 1 | | | | | | |
| 11 | | 1 | 1 | 1 | | | | | | |
| 12 | 1 | 1 | 1 | 1 | | | | | | |
| 17 | | 1 | 1 | | 1 | | | | | |
| 18 | 1 | 1 | 1 | | 1 | | | | | |
| 20 | | 1 | | 1 | 1 | | | | | |
| 21 | 1 | 1 | | 1 | 1 | | | | | |
| 22 | 1 | | 1 | 1 | 1 | | | | | |
| 23 | | 1 | 1 | 1 | 1 | | | | | |
| 24 | 1 | 1 | 1 | 1 | 1 | | | | | |
| 39 | | 1 | 1 | | 1 | 1 | | | | |
| 40 | 1 | 1 | 1 | | 1 | 1 | | | | |
| 42 | | 1 | | 1 | 1 | 1 | | | | |
| 43 | 1 | 1 | | 1 | 1 | 1 | | | | |
| 44 | 1 | | 1 | 1 | 1 | 1 | | | | |
| 45 | | 1 | 1 | 1 | 1 | 1 | | | | |
| 46 | 1 | 1 | 1 | 1 | 1 | 1 | | | | |
| 76 | | 1 | 1 | | 1 | 1 | 1 | | | |

FIG. 15B

| SF | 1 | 2 | 3 | 4 | 5 | 6 | 7 | 8 | 9 | 10 |
|---|---|---|---|---|---|---|---|---|---|---|
| Luminance weight | 1 | 2 | 3 | 6 | 12 | 22 | 37 | 45 | 57 | 71 |
| Gray scale value 77 | 1 | 1 | 1 | | 1 | 1 | 1 | | | |
| 79 | | 1 | | 1 | 1 | 1 | 1 | | | |
| 80 | 1 | 1 | | 1 | 1 | 1 | 1 | | | |
| 81 | 1 | | 1 | 1 | 1 | 1 | 1 | | | |
| 82 | | 1 | 1 | 1 | 1 | 1 | 1 | | | |
| 83 | 1 | 1 | 1 | 1 | 1 | 1 | 1 | | | |
| 121 | | 1 | 1 | | 1 | 1 | 1 | 1 | | |
| 122 | 1 | 1 | 1 | | 1 | 1 | 1 | 1 | | |
| 124 | | 1 | | 1 | 1 | 1 | 1 | 1 | | |
| 125 | 1 | 1 | | 1 | 1 | 1 | 1 | 1 | | |
| 126 | 1 | | 1 | 1 | 1 | 1 | 1 | 1 | | |
| 127 | | 1 | 1 | 1 | 1 | 1 | 1 | 1 | | |
| 128 | 1 | 1 | 1 | 1 | 1 | 1 | 1 | 1 | | |
| 178 | | 1 | 1 | | 1 | 1 | 1 | 1 | 1 | |
| 179 | 1 | 1 | 1 | | 1 | 1 | 1 | 1 | 1 | |
| 181 | | 1 | | 1 | 1 | 1 | 1 | 1 | 1 | |
| 182 | 1 | 1 | | 1 | 1 | 1 | 1 | 1 | 1 | |
| 183 | 1 | | 1 | 1 | 1 | 1 | 1 | 1 | 1 | |
| 184 | | 1 | 1 | 1 | 1 | 1 | 1 | 1 | 1 | |
| 185 | 1 | 1 | 1 | 1 | 1 | 1 | 1 | 1 | 1 | |
| 249 | | 1 | 1 | | 1 | 1 | 1 | 1 | 1 | 1 |
| 250 | 1 | 1 | 1 | | 1 | 1 | 1 | 1 | 1 | 1 |
| 252 | | 1 | | 1 | 1 | 1 | 1 | 1 | 1 | 1 |
| 253 | 1 | 1 | | 1 | 1 | 1 | 1 | 1 | 1 | 1 |
| 254 | 1 | | 1 | 1 | 1 | 1 | 1 | 1 | 1 | 1 |
| 255 | | 1 | 1 | 1 | 1 | 1 | 1 | 1 | 1 | 1 |
| 256 | 1 | 1 | 1 | 1 | 1 | 1 | 1 | 1 | 1 | 1 |

PLASMA DISPLAY DEVICE AND DRIVING METHOD OF PLASMA DISPLAY PANEL

THIS APPLICATION IS A U.S. NATIONAL PHASE APPLICATION OF PCT INTERNATIONAL APPLICATION PCT/JP2008/050162.

TECHNICAL FIELD

The present invention relates to a plasma display device used in wall-mount television or large-screen monitor and a driving method of plasma display panel.

BACKGROUND ART

A plasma display panel (or panel) is represented by an alternating-current surface discharge type panel, which is composed of a multiplicity of discharge cells formed between mutually opposite front board and rear board. The front board is composed of mutually parallel plural pairs of display electrode pairs each formed of a pair of scan electrode and sustain electrode formed on a front glass substrate, and a dielectric layer and a protective layer are formed to cover the display electrode pairs. The rear board is composed of a plurality of parallel data electrodes formed on a rear glass substrate, and a dielectric layer formed to cover them, and further a plurality of barrier walls are formed thereon parallel to the data electrodes, and a phosphor layer is formed on the surface of the dielectric layer and the side face of the barrier walls. The front board and the rear board are disposed oppositely and sealed so that the display electrode pairs and the data electrodes intersect three-dimensionally, and the inside discharge space is filled with a discharge gas containing xenon at partial pressure ratio of, for example, 5%. Discharge cells are formed in the opposing portions of the display electrode pairs and data electrodes. In the panel having such configuration, in each discharge cell, an ultraviolet ray is generated by gas discharge, and color phosphors of red (R), green (G), and blue (B) are excited by the ultraviolet ray to emit light, and a color display is formed.

The panel is driven generally by sub-field method, that is, one field period is divided into plural sub-fields, and light-emitting sub-fields are combined properly, and a gray scale display is made.

Each sub-field has an initializing period, an address period, and a sustain period. In the initializing period, an initializing discharge is generated, and a wall charge necessary for next address operation is formed on each electrode, and priming particles (explosives for discharging=exciting particles) are generated for generating the address discharge stably. In the address period, an address pulse voltage is selectively applied to the discharge cell for display, and an address discharge is generated to form a wall charge (this operation is called "address"). In the sustain period, a sustain pulse voltage is applied alternately to the display electrode pair formed of a scan electrode and a sustain electrode, and a sustain discharge is generated in the discharge cell causing the address discharge, and the phosphor layer of the corresponding discharge cell emit light, and an image is displayed.

In the sub-field method, a new driving method is developed, that is, the initializing discharge is generated by using a gently changing voltage waveform, and the discharge cell causing the sustain discharge is selectively initialized and discharged to minimize the light emission not relating to the gray scale display, and the contrast ratio is enhanced.

In this driving method, for example, in the initializing period of one sub-field out of the plurality of sub-fields, all discharge cells are initialized and discharged (that is, "all-cell initializing operation"), and in the initializing period of other sub-fields, only the discharge cells causing sustain discharge are initialized and discharged (that is, "selective initializing operation"). By driving in this manner, the light emission not relating to the image display is limited to the light emission by the all-cell initializing operation, and the luminance of black display region ("black luminance") is only very weak light emission in the all-cell initializing operation, and an image display of high contrast is achieved (see, for example, patent document 1).

This patent document also discloses a so-called narrow width erase discharge, that is, the pulse width of the final sustain pulse in the sustain period is made shorter than the pulse width of other sustain pulses, and the potential difference by wall charge between the discharge electrode pairs is lessened. By generating this narrow width erase discharge stably, a reliable address operation is realized in the subsequent address period of sub-fields, and a plasma display device of high contrast ratio is realized.

Recently, in the trend of higher definition of panel and large area of screen, the plasma display device is demanded to be higher in the image display quality. One of the means for enhancing the image display quality is an elevation of luminance. To raise the luminance of light emission, it is effective to raise the partial pressure of xenon, but the voltage necessary for writing is increase, and the writing becomes unstable. In such panel, still more, the dark current (the current occurring in the discharge cells regardless of discharge) increases, and the wall charge formed in the initializing period decreases until the subsequent address operation ("discharge loss occurs"), and in spite of writing, sustain discharge does not occur in certain discharge cells (such cells are called "unlit cells").

Patent document 1: Unexamined Japanese Patent Publication No. 2000-242224

DISCLOSURE OF THE INVENTION

The plasma display device of the present invention includes a panel having a plurality of discharge cells, each of the discharge cells having a display electrode pair formed of a scan electrode and a sustain electrode, and a driving circuit for driving the panel having a plurality of sub-fields provided in one field, each having an initializing period for initializing the discharge cell by applying a gently descending ramp waveform voltage to the scan electrode, an address period for addressing selectively the discharge cells to be discharged, and a sustain period for causing sustain discharge by a number of times corresponding to a luminance weight in the discharge cells addressed in the address period, and the driving circuit has a sub-field group formed of plural continuous sub-fields, and if there is a non-emitting sub-field in the sub-field group, the gray scale value for not emitting continuously from this non-emitting sub-field to the sub-field of the largest luminance weight in the sub-field group is used as the gray scale value for display, and the lowest voltage of the ramp waveform voltage is made different between the sub-field included in the sub-field group and other sub-fields.

As a result, the panel is heightened in luminance, but the applied voltage necessary for generating the address discharge is not increased, and stable address discharge is generated, and the number of unlit cells can be decreased.

Thus, in the panel heightened in luminance, the second voltage to be applied to the sustain electrode in the address period is changed depending on the cumulative time of power supply time to the panel, and if the cumulative time of power supply time to the panel is increased, the address pulse voltage is not raised, and a stable address discharge can be achieved.

BRIEF DESCRIPTION OF THE DRAWINGS

FIG. 5A is a coding diagram in a preferred embodiment of the present invention.

FIG. 5B is a coding diagram in a preferred embodiment of the present invention.

FIG. 5C is a coding diagram in a preferred embodiment of the present invention.

FIG. 6A is an explanatory diagram of first coding and second coding in a preferred embodiment of the present invention.

FIG. 6B is an explanatory diagram of first coding and second coding in a preferred embodiment of the present invention.

FIG. 15A is a diagram showing other example of coding in a preferred embodiment of the present invention.

FIG. 15B is a diagram showing another example of coding in a preferred embodiment of the present invention.

DESCRIPTION OF THE REFERENCE NUMERALS

Figure 1:
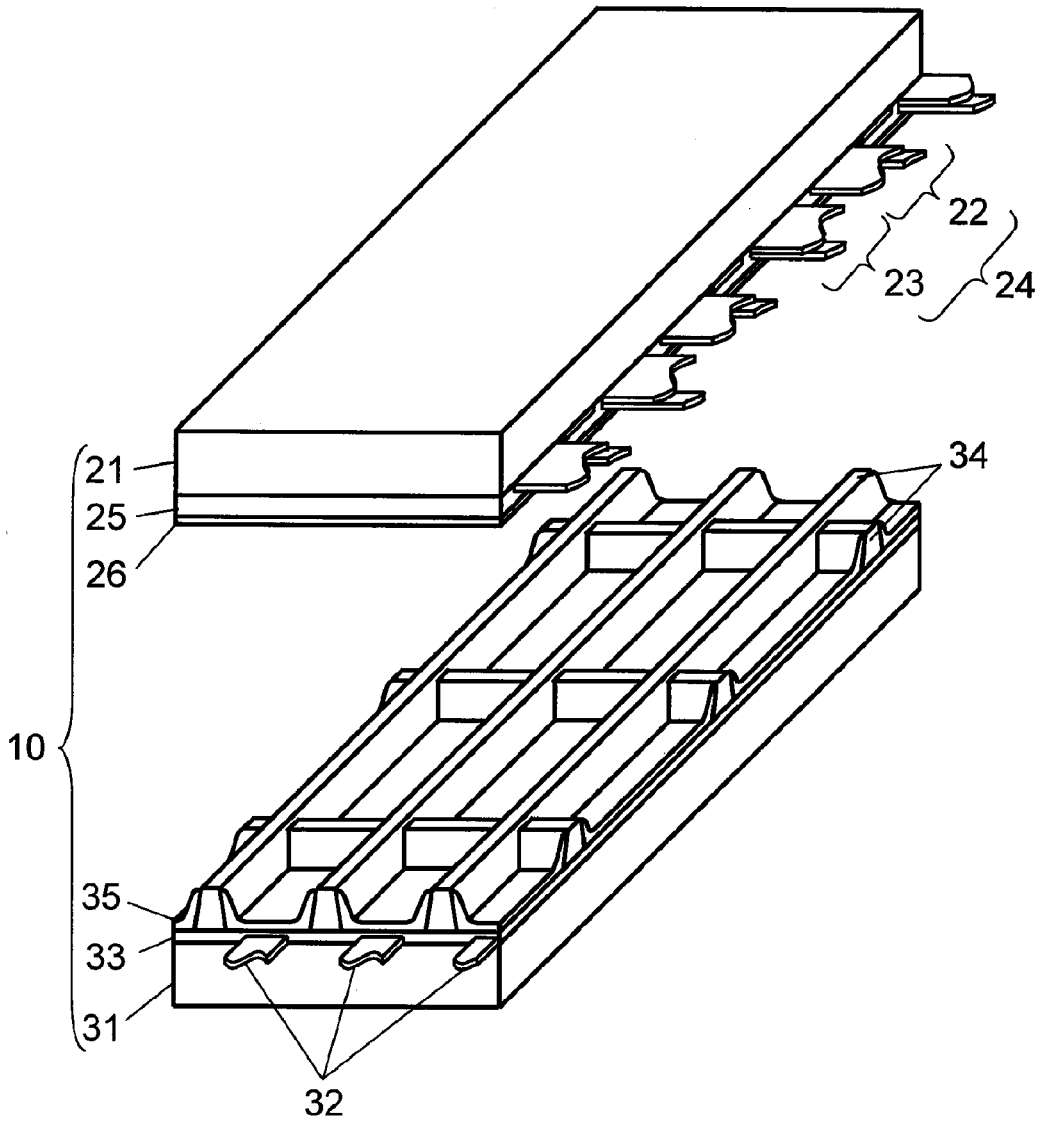
FIG. 1 is a perspective exploded view of structure of panel in a preferred embodiment of the present invention.

1 Plasma display device
10 Panel
21 Front board
22 Scan electrode
23 Sustain electrode
24 Display electrode pair
25, 33 Dielectric layer
26 Protective layer
31 Rear board
32 Data electrode
34 Barrier wall
35 Phosphor layer
41 Image signal processing circuit
42 Data electrode driving circuit
43 Scan electrode driving circuit
44 Sustain electrode driving circuit
45 Timing generation circuit
50 Sustain pulse generation circuit
51 Power recovery circuit
52 Clamp circuit
53 Initializing waveform generation circuit
54 Scan pulse generation circuit
Q1, Q2, Q3, Q4, Q11, Q12, Q13, Q14, Q21, Q22, Q23, QH1 to QHn, QL1 to QLn Switching element
C1, C10, C11, C12, C21 Capacitor
R10, R11 Resistor
INa, INb Input terminal
D1, D2, D10, D21 Diode
L1 Inductor
IC1 to ICn Control circuit
CP Comparator
AG AND gate

DETAILED DESCRIPTION OF PREFFERED EMBODIMENTS

The plasma display device in a preferred embodiment of the present invention is described below while referring to the drawing.

Preferred Embodiments

FIG. 1 is a perspective exploded view of structure of panel 10 in a preferred embodiment of the present invention. On front board 21 of glass material, a plurality of display electrode pairs 24 each formed of scan electrode 22 and sustain electrode 23 are formed. Dielectric layer 25 is formed to cover scan electrode 22 and sustain electrode 23, and protective layer 26 is formed on dielectric layer 25.

Protective layer 26 is formed of a material known as a panel material for lowering the discharge start voltage of discharge cells, mainly composed of MgO excellent in durability and large in secondary electron discharge coefficient when packed with neon (Ne) and xenon (Xe) gas.

A plurality of data electrodes 32 are formed on rear board 31, and dielectric layer 33 is formed to cover data electrodes 32, and barrier walls 34 are formed thereon in a form of crossing pairs. On the side face of barrier wall 34 and on the surface of dielectric layer 33, phosphor layers 35 for emitting light in red (R), green (G), and blue (B) colors are provided.

Front board 21 and rear board 31 are disposed oppositely so that display electrode pairs 24 and data electrodes 32 may intersect with each other across a small discharge space, and the outer circumference is sealed with a sealing material such as glass frit. The discharge space is packed with discharge gas, such as mixed gas of neon and xenon. In the present preferred embodiment, to enhance the luminance, the discharge gas with xenon partial pressure of about 10% is used. The discharge space is divided into a plurality of partitions by barrier walls 34, and discharge cells are formed at intersecting portions of display electrode pairs 24 and data electrodes 32. An image is displayed when the discharge cells are discharged and emit light.

The structure of panel 10 is not limited to the above example, and may be provided with, for example, stripe-like barrier walls. The mixing ratio of the mixed gas is not particularly specified, and the gases may be mixed at different ratio.

Figure 2:
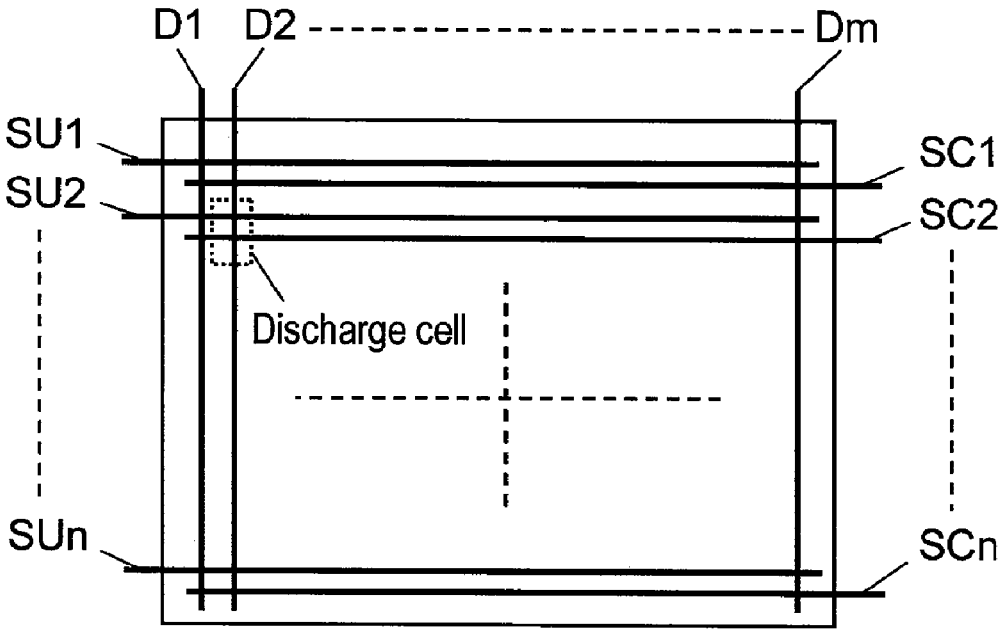
FIG. 2 is an electrode layout diagram of the panel.

FIG. 2 is an electrode layout diagram of panel 10 in a preferred embodiment of the present invention. Panel 10 is composed of long n pieces of scan electrode SC1 to scan electrode SCn (scan electrodes 22 in FIG. 1) and n pieces of sustain electrode SU1 to sustain electrode SUn (sustain electrodes 23 in FIG. 23) arrayed in column direction, and long m pieces of data electrode D1 to data electrode Dm (data electrodes 32 in FIG. 1) arrayed in row direction. Discharge cells are formed in intersecting portions of a pair of scan electrode SCi (i=1 to n) and sustain electrode SUi and one data electrode Dj (j=1 to m), and m×n pieces of discharge cells are formed in the discharge space.

The driving voltage waveform for driving panel 10 and its operation are explained. The plasma display device of the present preferred embodiment is driven by the sub-field method, that is, one field period is divided into plural sub-fields, and emission and non-emission of discharge cells in each sub-field are controlled, and a gray scale display is made. Each sub-field has an initializing period, an address period, and a sustain period.

In each sub-field, in the initializing period, an initializing discharge is generated, and a wall charge necessary for next address discharge is formed on each electrode. In addition, priming particles (explosives for discharging=exciting particles) are generated for generating the address discharge stably by reducing the discharge delay. At this time, the initializing operation includes all-cell initializing operation generate for initializing and discharging in all discharge cells, and selective initializing operation generate for initializing and discharging in discharge cells causing sustain discharge in one sub-field before.

In the address period, an address discharge is generated selectively in the discharge cells for emitting light in the subsequent sustain period, and a wall charge is formed. In the sustain period, a sustain pulse is applied alternately to display electrode pair 24 by the number proportional to the luminance weight, and the sustain discharge is generated in the discharge cells causing address discharge, and light is emitted. At this time, the proportional constant is called "luminance scale factor".

In the present preferred embodiment, depending on the difference in the coding described below (the combination of sub-fields for emitting light), it is intended to control the lowest voltage of the ramp waveform voltage descending gently to be applied to scan electrode SC1 to scan electrode SCn generated in the initializing period. Specifically, in the initializing period of sub-fields for controlling light emission on the basis of the first coding described below, a ramp waveform voltage is generated by setting the lowest voltage of the ramp waveform voltage descending gently to a lower voltage, and in the initializing period of sub-fields for controlling light emission on the basis of the second coding described below, a ramp waveform voltage is generated by setting the lowest voltage of the ramp waveform voltage descending gently to a higher voltage. As a result, a stable address discharge can be generated without increasing the applied voltage necessary for generating the address discharge, and occurrence of unlit cell is decreased. First, the outline of driving voltage waveform is explained, and the first coding and second coding are explained, and the difference is described between the driving voltage waveform in the sub-fields for controlling light emission according to the first coding and the driving voltage waveform in the sub-fields for controlling light emission according to the second coding.

Figure 3:
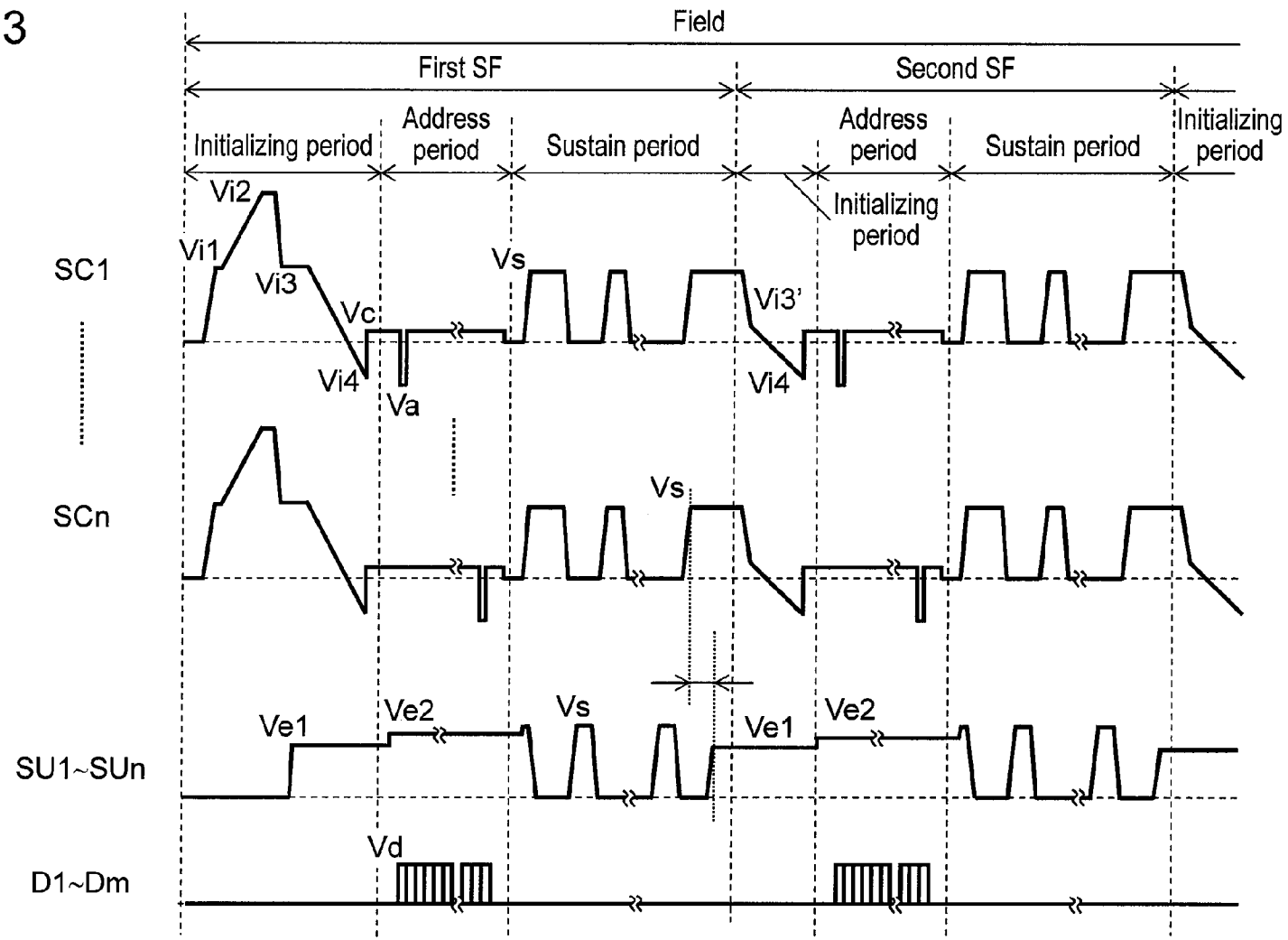
FIG. 3 is a driving voltage waveform diagram to be applied to electrodes of the panel.

FIG. 3 is a driving voltage waveform diagram to be applied to the electrodes of panel 10 in a preferred embodiment of the present invention. FIG. 3 shows driving voltage waveforms of two sub-fields, that is, the sub-field for initializing all cells ("all-cell initializing sub-field"), and the sub-field for initializing selectively ("selective initializing sub-field"), but the driving voltage waveform is nearly same in other sub-fields.

The all-cell initializing sub-field, or the first SF, is explained. In the first half of initializing period of first SF, 0 V is applied to data electrode D1 to data electrode Dm, and sustain electrode SU1 to sustain electrode SUn, and in scan electrode SC1 to scan electrode SCn, a ramp waveform voltage ascending gently from voltage Vi1 below the discharge start voltage toward voltage Vi2 above the discharge start voltage ("up-ramp waveform voltage") is applied to sustain electrode SU1 to sustain electrode SUn.

In the rising period of this up-ramp waveform voltage, a feeble initializing discharge occurs continuously between scan electrode SC1 to scan electrode SCn, and sustain electrode SU1 to sustain electrode SUn, and data electrode D1 to data electrode Dm. A negative wall voltage is accumulated in the upper parts of scan electrode SC1 to scan electrode SCn, and a positive wall voltage is accumulated in the upper parts of data electrode D1 and data electrode Dm and in the upper parts of sustain electrode SU1 to sustain electrode SUn. The wall voltage in the upper part of the electrode is a voltage caused by the wall charge accumulated on the dielectric layer, on the protective layer, or on the phosphor covering the electrodes.

In the second half of initializing period, positive voltage Ve1 is applied to sustain electrode SU1 to sustain electrode SUn, and 0 V is applied to data electrode D1 to data electrode Dm, and in scan electrode SC1 to scan electrode SCn, a ramp waveform voltage descending gently from voltage Vi3 below the discharge start voltage toward voltage Vi4 above the discharge start voltage ("down-ramp waveform voltage") is applied to sustain electrode SU1 to sustain electrode SUn (hereinafter, the minimum value of the down-ramp waveform voltage applied to scan electrode SC1 to scan electrode SCn is called "initializing voltage Vi4"). In this period, a feeble initializing discharge occurs continuously between scan electrode SC1 to scan electrode SCn, and sustain electrode SU1 to sustain electrode SUn, and data electrode D1 to data electrode Dm. As a result, the negative wall voltage in the upper parts of scan electrode SC1 to scan electrode SCn, and the positive wall voltage in the upper parts of sustain electrode SU1 to sustain electrode SUn are weakened, and the positive wall voltage in the upper parts of data electrode D1 to data electrode Dm is adjusted to a voltage suited to address operation. This is the end of all-cell initializing operation for initializing all discharge cells.

In the present preferred embodiment, the voltage value of this initializing voltage Vi4 is changed over between two different voltage values, and thereby panel 10 is driven. Although not shown in FIG. 3, the higher voltage is Vi4H and the lower voltage is Vi4L.

In the initializing period of the sub-field for controlling light emission according to the first coding explained below, it is designed to initialize by the down-ramp waveform voltage by setting initializing voltage Vi4 at Vi4L, and in the initializing period of the sub-field for controlling light emission according to the second coding explained below, it is designed to initialize by the down-ramp waveform voltage by setting initializing voltage Vi4 at Vi4H. This operation is specifically described below.

In the subsequent address period, voltage Ve2 is applied to sustain electrode SU1 to sustain electrode SUn, and voltage Vc is applied to scan electrode SC1 to scan electrode SCn.

First, negative scan pulse voltage Va is applied to scan electrode SC1 of the first column, and positive address pulse voltage Vd is applied to data electrode Dk (k=1 to m) of the discharge cell for emitting light on the first column out of data electrode D1 to data electrode Dm. A this time, the voltage difference at the intersection of data electrode Dk and scan electrode SC1 is the sum of difference of external applied voltages (Vd−Va) and difference of wall voltage on data electrode Dk and wall voltage on scan electrode SC1, and hence it exceeds the discharge start voltage. Consequently, an address discharge occurs between data electrode Dk and scan electrode SC1, and between sustain electrode SU1 and scan electrode SC1, and a positive wall voltage is accumulated on scan electrode SC1, and a negative wall voltage is accumulated on sustain electrode SU1 and a negative wall voltage is also accumulated on data electrode Dk.

In this way, the address discharge is generated by the discharge cell for emitting light on the first column, and the wall voltage is accumulated on the electrodes in address operation. On the other hand, the voltage at the intersection of data electrode D1 to data electrode Dm and scan electrode SC1 not applied with address pulse voltage Vd does not exceed the discharge start voltage, and address discharge does not occur. The same address operation is executed up to the discharge cell of n-th column, and the address period is terminated.

In the subsequent sustain period, positive sustain pulse voltage Vs is applied to scan electrode SC1 and scan electrode SCn, and 0 V is applied to sustain electrode SU1 to sustain electrode SUn. As a result, in the discharge cell occurring the address discharge, the voltage difference of scan electrode SCi and sustain electrode SUi is the sum of sustain pulse voltage Vs and difference of wall voltage on scan electrode SCi and wall voltage on sustain electrode SUi, and hence it exceeds the discharge start voltage.

Consequently, a sustain discharge occurs between scan electrode SCi and sustain electrode SUi, and an ultraviolet ray is caused, and thereby phosphor layer 35 emits light. A negative wall voltage is accumulated on scan electrode SCi, and a positive wall voltage is accumulated on sustain electrode SUi. Further, a positive wall voltage is accumulated on data electrode Dk. In the discharge cells not causing address discharge in the address period, sustain discharge is not generated, and the wall voltage is maintained at the end of the initializing period.

Successively, 0 V is applied to scan electrode SC1 to scan electrode SCn, and sustain pulse voltage Vs is applied to sustain electrode SU1 to sustain electrode SUn. As a result, in the discharge cells causing sustain discharge, the voltage difference between sustain electrode SUi and scan electrode SCi exceeds the discharge start voltage, and a sustain discharge occurs again between sustain electrode SUi and scan electrode SCi, and a negative wall voltage is accumulated on sustain electrode SUi and a positive wall voltage is accumulated on scan electrode SCi. Thereafter, similarly, sustain pulses are applied between scan electrode SC1 to scan electrode SCn and sustain electrode SU1 to sustain electrode SUn, alternately by the number corresponding to the product of the luminance weight multiplied by the luminance scale factor, and a potential difference is applied between electrodes in display electrode pair 24, so that the sustain discharge continues in the discharge cells causing the address discharge in the address period.

At the end of the sustain period, a voltage difference of so-called narrow width pulse is applied between scan electrode SC1 and scan electrode SCn and sustain electrode SU1 and sustain electrode SUn, and while leaving the positive wall voltage on data electrode Dk, the wall voltage on scan electrode SCi and on sustain electrode SUi is erased. This discharge is called erase discharge.

Thus, voltage Vs for generating final sustain discharge, that is, erase discharge is applied to scan electrode SC1 to scan electrode SCn, and after a specified time interval, voltage Ve1 for lessening the potential difference between the electrodes of display electrode pair 24 is applied to sustain electrode SU1 to sustain electrode SUn. Thus, the sustain operation in the sustain period is terminated.

Following is explanation about operation in selective initializing sub-field, or second SF.

In the selective initializing period of second SF, a driving voltage waveform omitting the fist half of the all-cell initializing period is applied to the electrodes. That is, while voltage Ve1 is applied to sustain electrode SUi and sustain electrode SUn, and 0 V is applied to data electrode D1 and data electrode Dm, a down-ramp waveform voltage descending gently from voltage Vi3' to initializing voltage Vi4 is applied to scan electrode SC1 to scan electrode SCn.

As a result, a feeble initializing discharge occurs in the discharge cells causing sustain discharge in the sustain period of the preceding sub-field, and the wall voltage on scan electrode SCi and sustain electrode SUi is weakened. On data electrode Dk, since a sufficient positive wall voltage is accumulated on data electrode Dk by the immediately preceding sustain discharge, and the excessive portion of wall voltage is discharged, and the wall voltage is adjusted to be suitable to the address operation.

On the other hand, in the discharge cells not causing sustain discharge in the preceding sub-field, without discharging, the wall charge at the end of the initializing period of the preceding sub-field is maintained. Thus, the selective initializing operation is an initializing operation executed selectively on the discharge cells performing the sustain operation in the sustain period in the preceding sub-field.

The subsequent address period operation is same as the operation in the address period in all-cell initializing sub-field, and the explanation is omitted. The subsequent sustain period operation is also same except of the number of sustain pulses. In third SF to tenth SF, the initializing period operation is same as the selective initializing operation in second SF, and the address period operation is also same as in second SF, and the sustain period operation is also same except for the number of sustain pulses.

Figure 4:
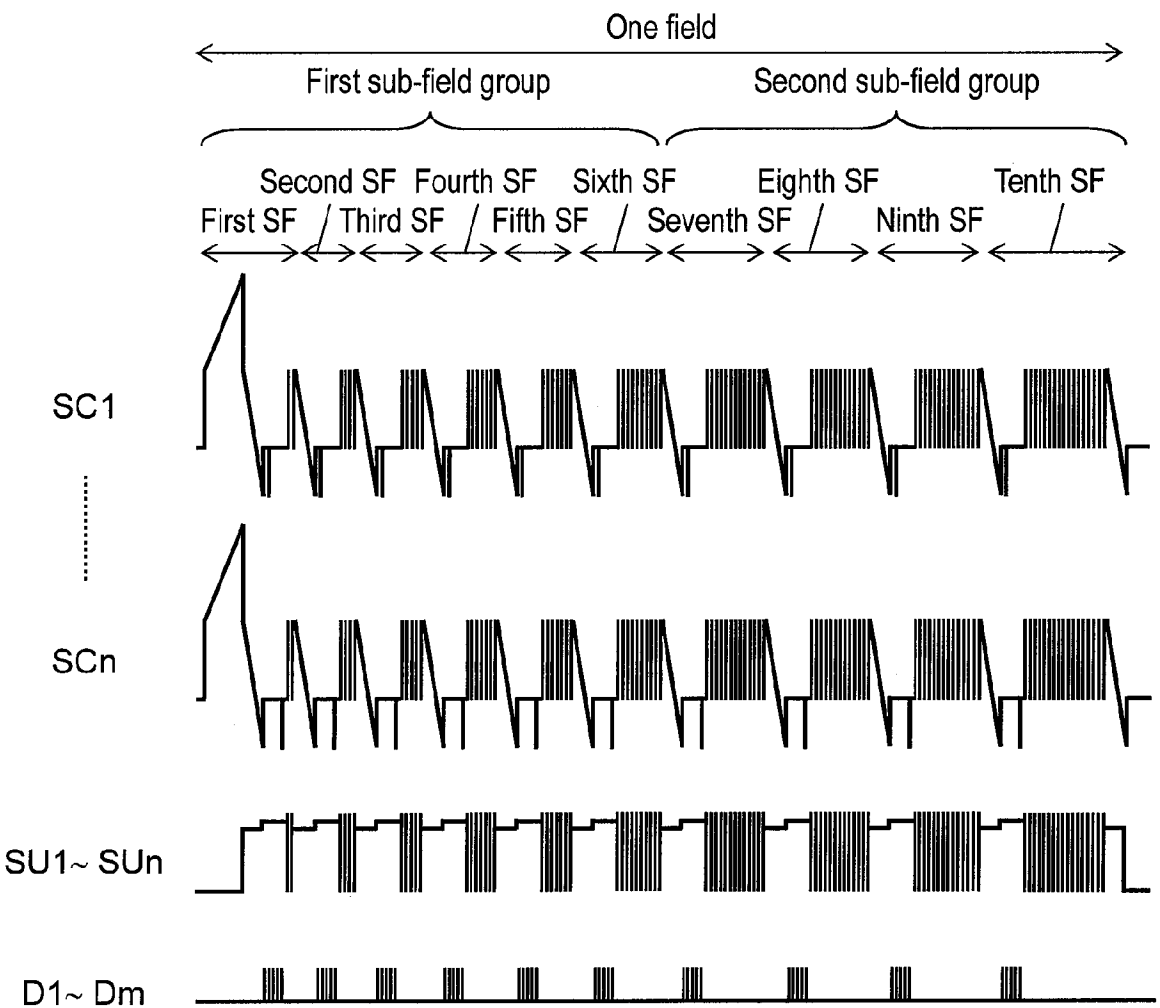
FIG. 4 is a diagram showing a sub-field configuration in a plasma display panel device in a preferred embodiment of the present invention.

FIG. 4 is a diagram showing sub-field composition in the plasma display device in a preferred embodiment of the present invention. FIG. 4 schematically shows the driving waveform in one field in the sub-field method, and the driving voltage waveform of each sub-field is same as the driving voltage waveform in FIG. 3.

As shown in FIG. 4, in the present preferred embodiment, one field is divided into ten sub-fields (first SF, second SF, . . . , tenth SF), and each sub-field has its own luminance weight (1, 2, 3, 6, 12, 22, 37, 45, 57, 71). As mentioned above, the first SF is an all-cell initializing sub-field for initializing all cells, and the second SF to the tenth SF are selective initializing sub-fields for initializing selectively. By such configuration of sub-fields, the light emission not relating to image display is reduced, and an image display of high contrast is realized. In the sustain period of each sub-field, sustain pulses in the number corresponding to the product of luminance weight of each sub-field multiplied by the specified luminance scale factor are applied to each display electrode pair 24. In the present preferred embodiment, as mentioned below, the sub-fields of small luminance weight (herein, the first SF to the sixth SF) are gathered as first sub-field group, and the sub-fields of large luminance weight (the seventh SF to the tenth SF) are gathered as second sub-field group. However, the number of sub-fields or the luminance weigh of each sub-field are not limited to these numerical values, and the configuration of sub-fields may be varied depending on the image signals and others.

Following is explanation about coding in the present preferred embodiment, that is, the combination of gray scale value used in image display and sub-fields for emitting light for displaying the gray scale value. FIG. 5A, FIG. 5B, and FIG. 5C are coding diagrams in a preferred embodiment of the present invention. FIG. 5A shows a coding from gray scale value 0 to gray scale value 44, FIG. 5B shows a coding from gray scale value 45 to gray scale value 172, and FIG. 5C shows a coding from gray scale value 173 to gray scale value 256. In FIG. 5A, FIG. 5B, and FIG. 5C, a sub-field indicated by "1" is a sub-field for emitting light (emitting sub-field), and a sub-field of blank column is a sub-field for not emitting light (non-emitting sub-field).

In the present preferred embodiment, the sub-fields of small luminance weight (herein, the first SF to the sixth SF) are gathered as first sub-field group, and the first sub-field group controls emission and non-emission in the sub-fields on the basis of the first coding. The sub-fields of large luminance weight (the seventh SF to the tenth SF) are gathered as second sub-field group, and the second sub-field group controls emission and non-emission in the sub-fields on the basis of the second coding, thereby displaying the gray scales.

Only the gray scale values conforming to the rules of both first coding and second coding are gray scale values to be used in image display.

The first coding and second coding are explained. FIG. 6A and FIG. 6B are diagrams explaining the first coding and second coding in the present preferred embodiment of the present invention. FIG. 6A shows part excerpted from gray scale value 0 to gray scale value 71, and FIG. 6B shows part excerpted from gray scale value 127 to gray scale value 256. In the present preferred embodiment, since one field is divided into ten sub-fields (first SF, second SF, . . . , tenth SF), each having its own luminance weight (1, 2, 3, 6, 12, 22, 37, 45, 57, 71), and by combining emission and non-emission of each sub-field, the gray scale from 0 (non-emission in all sub-field) and 256 (emission in all sub-fields), but part is excerpted in FIG. 6A and FIG. 6B. In FIG. 6A and FIG. 6B, the gray scale value shown in the blank column is the gray scale value used in image display, and the gray scale value shown in the slash column is the gray scale value not used in image display. That is, the gray scale values extracted from those shown in the blank column are same as shown in FIG. 5A, FIG. 5B and FIG. 5C.

The first coding is explained.

In the present preferred embodiment, as mentioned above, in order to enhance the contrast of the display image, the second SF and tenth SF are defined as selective initializing sub-fields. In the selective initializing field, only the discharge cells causing sustain discharge in the immediately preceding sub-field are initialized, and the discharge cells not causing sustain discharge are not initialized. Hence, in the discharge cells not causing sustain discharge, the wall charge at the end of initializing period in the preceding sub-field is used in writing in the subsequent sub-field. However, the wall charge is lost along with the lapse of the time, and the discharge cells not causing sustain discharge may possibly encounter address failure due to lack of wall charge in the subsequent sub-fields. As the non-emitting sub-fields increase, more wall charge is likely to be lost, and the risk of address failure is higher.

In the first sub-field group (first SF to sixth SF), for displaying each gray scale value, the gray scale values having two or more non-emitting sub-fields between the sub-field of largest luminance weight among the emitting sub-fields and the first SF are not used in display, and other gray scale values are used in display. However, when the seventh SF is an emitting sub-field and the sixth SF is a non-emitting sub-field, the sixth SF is counted as a non-emitting sub-field, and the first SF of smallest luminance weight is, if non-emitting, is not counted as non-emitting sub-field.

Herein, the gray scale value "8" in which only the third SF is a non-emitting sub-field, and the gray scale value "60" and gray scale value "61" in which only the sixth SF is a non-emitting sub-field are the gray scale values for display conforming to this rule.

In the present preferred embodiment, such coding is called the first coding.

The second coding is explained.

As mentioned above, since the wall charge is lost gradually along with the lapse of time, and in the sub-field of large luminance weight and long sustain period, more wall charge may be lost in the non-emitting sub-field, and the risk of writing failure is higher. Therefore, in the second sub-field group (seventh SF to tenth SF) of longer sustain period than in the first sub-field group, when displaying each gray scale value, the gray scale value having non-emitting sub-field immediately before the emitting sub-field is not used for display, and other gray scale values are used for display. That is, the second sub-field group (seventh SF to tenth SF) is a sub-field group composed of two or more consecutive sub-fields for controlling the writing so as not to cause sustain discharge also in the sub-fields following the sub-field in the discharge cells not causing sustain discharge.

For example, the gray scale value "60" and gray scale value "61" for illuminating only the seventh SF, the gray scale value "127" and gray scale value "128" for illuminating only the seventh SF and the eighth SF continuously, or the gray scale value "249" and gray scale value "250" for illuminating only the seventh SF to the tenth SF continuously are the gray scale values for display conforming to this rule.

In the present preferred embodiment, such coding is called the second coding.

Also in the present preferred embodiment, as shown in FIG. 5A, FIG. 5B, FIG. SC, FIG. 6A, and FIG. 6B, only the gray scale values conforming to the rules of both first coding and second coding are gray scale values to be used in image display.

Thus in the present preferred embodiment, one field is divided into two sub-field groups, first sub-field group and second sub-field group, and in each sub-field group, an appropriate coding depending on the luminance weight is applied, and occurrence of unlit cells caused by writing failure can be reduced while assuring the number of gray scales used in image display and suppressing occurrence of writing failure.

In this coding, discontinuous positions of gray scale values occur, but such discontinuous gray scale values can be compensated by a general method, such as error dispersion method or dither technique.

In the present preferred embodiment, as initializing voltage Vi4 of down-ramp waveform voltage to be applied to scan electrode SC1 to scan electrode SCn in the initializing period, different voltage values are generated in the sub-field for controlling the writing according to the first coding and the sub-field for controlling the writing according to the second coding. The detail is explained below.

Figure 7:
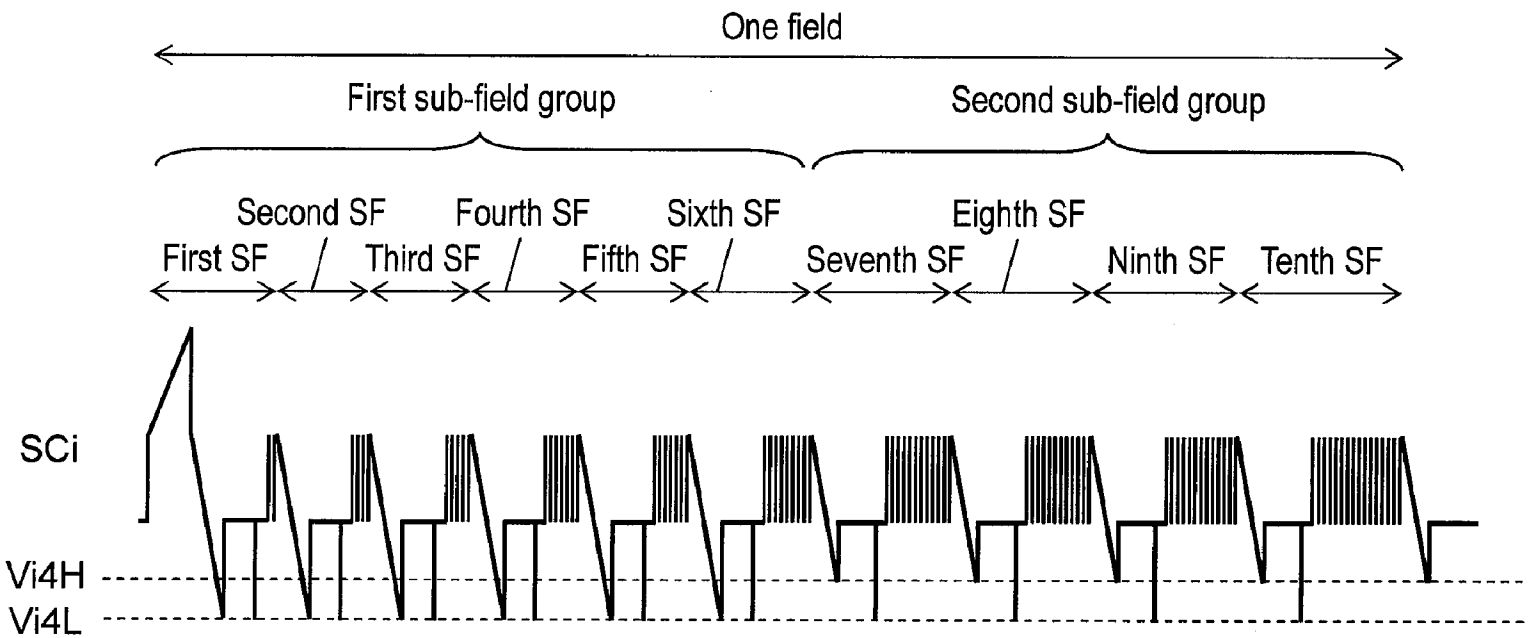
FIG. 7 is a driving voltage waveform diagram of driving voltage waveform to be applied to a scan electrode in a preferred embodiment of the present invention.

FIG. 7 is a waveform diagram of driving voltage waveform to be applied to scan electrode SC1 to scan electrode SCn in the preferred embodiment of the present invention.

In the present preferred embodiment, as mentioned above, initializing voltage Vi4 as the lowest voltage of down-ramp waveform voltage is changed over between two different voltage values, that is, lower voltage Vi4L and higher voltage Vi4H, and thereby the down-ramp waveform voltage is generated.

As shown in FIG. 7, in the initializing period of first sub-field group (first SF to sixth SF) for controlling emission and non-emission by the first coding, it is designed to initialize by generating a down-ramp waveform voltage setting initializing voltage Vi4 at Vi4L, and in the initializing period of second sub-field group (seventh SF to tenth SF) for controlling emission and non-emission by the second coding, it is designed to initialize by generating a down-ramp waveform voltage setting initializing voltage Vi4 at Vi4H higher than Vi4L. In the present preferred embodiment, by such configuration, a stable address discharge is generated without heightening the applied voltage necessary for generating the address discharge. The reason is as follows.

In the initializing operation for generating an initializing discharge by down-ramp waveform voltage, the duration time of initializing discharge varies depending on the voltage value of initializing voltage Vi4. Hence, the state of wall charge necessary for address discharge to be formed on each electrode varies with the voltage value of initializing voltage Vi4, and the voltage to be applied necessary for subsequent address discharge also changes. Hence, the following relation is established among them.

Figure 8:
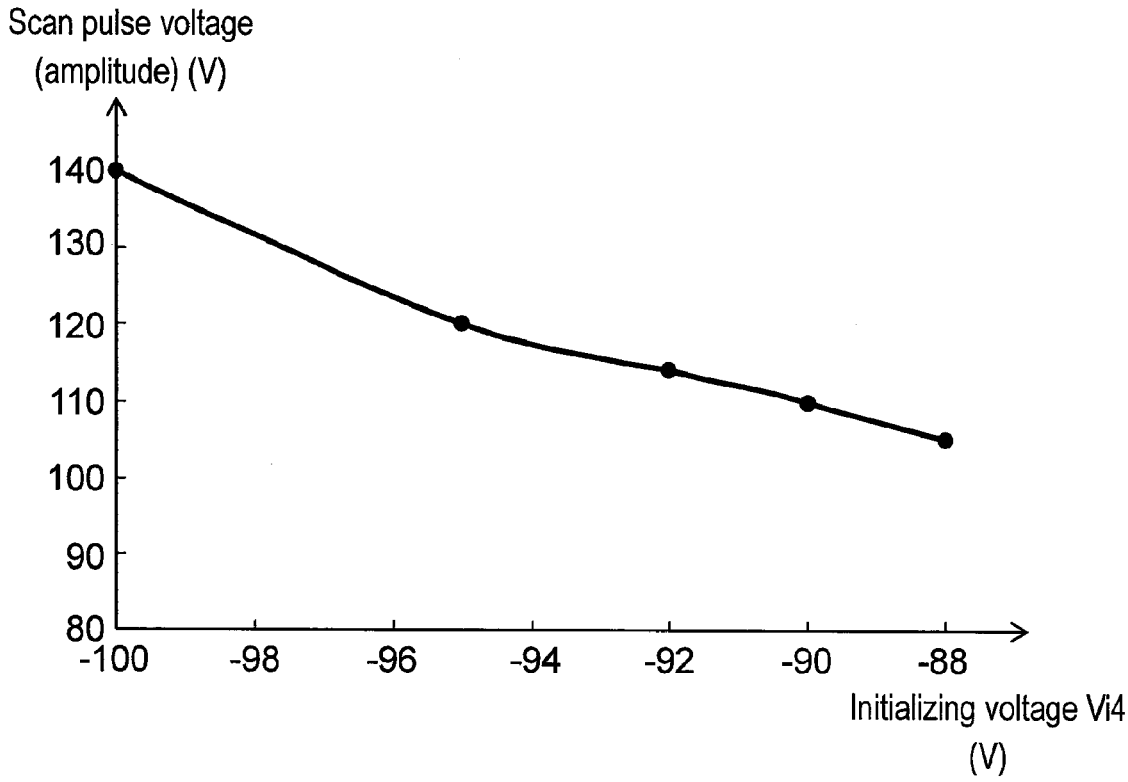
FIG. 8 is a diagram showing the relation between initializing voltage Vi4 and scan pulse voltage necessary for generating a stable address discharge in a preferred embodiment of the present invention.

FIG. 8 is a characteristic diagram showing the relation between initializing voltage Vi4 and scan pulse voltage necessary for generating a stable address discharge in a preferred embodiment of the present invention. In FIG. 8, the axis of ordinates represents the scan pulse voltage (amplitude) necessary for generating a stable address discharge, and the axis of abscissas denotes initializing voltage Vi4. In FIG. 8, when initializing voltage Vi4 is changed (herein, from −100 V to −88 V), the graph shows changes of scan pulse voltage (amplitude) necessary for generating a stable address discharge.

As shown in FIG. 8, depending on the voltage of initializing voltage Vi4, the scan pulse voltage (amplitude) necessary for generating a stable address discharge is changed, and when the voltage of initializing voltage Vi4 is raised (herein initializing voltage Vi4 is changed from −100 V to −88 V), the scan pulse voltage (amplitude) necessary for generating a stable address discharge is decreased. For example, when initializing voltage Vi4 is about −95 V, the necessary scan pulse voltage (amplitude) is about 120 V, but initializing voltage Vi4 is about −90V, the necessary scan pulse votage (amplitude) is about 110V, that is, about 10 V smaller.

The sub-field for changing initializing voltage Vi4, and the scan pulse voltage necessary for generating a stable address discharge are in the relation as described below, and to obtain the effect of reducing the scan pulse voltage, it has been found that it is not always necessary to enhance initializing voltage Vi4 in all sub-fields (for example, setting initializing voltage Vi4 to Vi4H).

Figure 9:
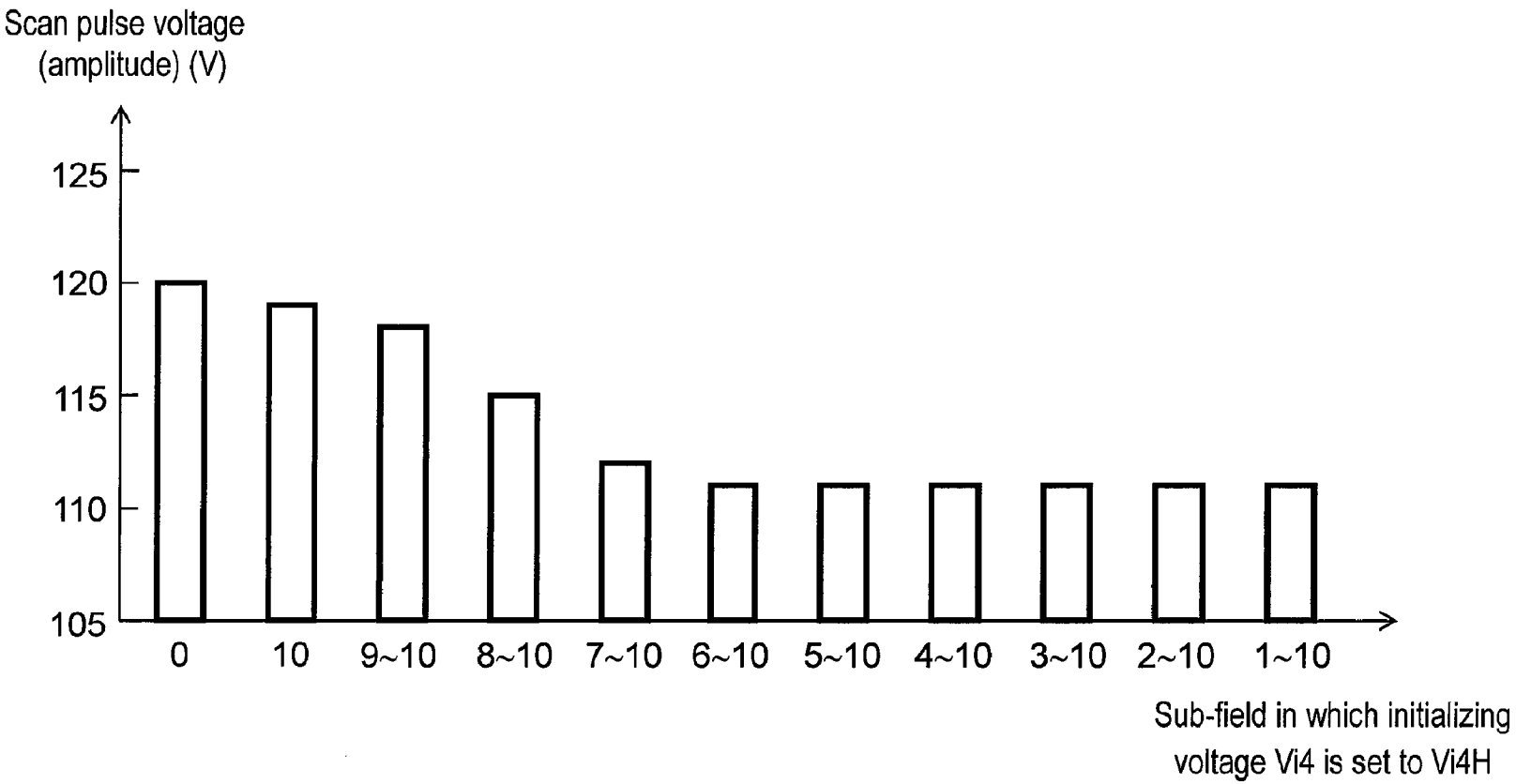
FIG. 9 is a diagram showing the relation between a subfield for setting initializing voltage Vi4 to Vi4H and scan pulse voltage necessary for generating a stable address discharge in a preferred embodiment of the present invention.

FIG. 9 is a diagram showing the relation between a sub-field for setting initializing voltage Vi4 to Vi4H and scan pulse voltage necessary for generating a stable address discharge in a preferred embodiment of the present invention. In FIG. 9, the axis of ordinates represents the scan pulse voltage (amplitude) necessary for generating a stable address discharge, and the axis of abscissas denotes the sub-field for generating a down-ramp waveform voltage by setting initializing voltage Vi4 to Vi4H. For example, on the axis of abscissas, "10" shows that initializing voltage Vi4 is set to Vi4H by the tenth SF only, and that initializing voltage Vi4 is set to Vi4L by the first SF to the ninth SF. Similarly, "6 to 10" shows that initializing voltage Vi4 is set to Vi4H by the sixth SF to the tenth SF, and that initializing voltage Vi4 is set to Vi4L by the first SF to the fifth SF. Further, "0" shows that initializing voltage Vi4 is set to Vi4L by all sub-fields (the first SF to the tenth SF). Herein, Vi4L is −95 V, and Vi4H is −90 V, 5 V higher than Vi4L.

As shown in FIG. 9, as the sub-fields for setting initializing voltage Vi4 to Vi4H increase sequentially from the tenth SF of the largest luminance weight, the scan pulse voltage necessary for generating a stable address discharge is gradually decreased. For example, when initializing voltage Vi4 is set to Vi4H by the tenth SF alone, the necessary scan pulse voltage (amplitude) is about 119 V, but when initializing voltage Vi4 is set to Vi4H by the sixth SF to the tenth SF, the necessary scan pulse voltage (amplitude) is about 111 V, and about 8 V is decreased.

However, when initializing voltage Vi4 is set to Vi4H by the sixth SF to the tenth SF, if initializing voltage Vi4 is set to Vi4H by the sub-fields smaller in luminance weight than the sixth SF, no change occurs in the necessary scan pulse voltage (amplitude). Hence, in order to obtain the effect of decreasing the necessary scan pulse voltage, it is confirmed that initializing voltage Vi4 should be set to Vi4H in the sub-fields of relatively large luminance weight.

On the other hand, the following relation is known between initializing voltage Vi4 and address pulse voltage Vd necessary for generating a stable address discharge, and when initializing voltage Vi4 is raised, it is known that the possibility of occurrence of unlit cells is increased due to worsening of charge loss.

Figure 10:
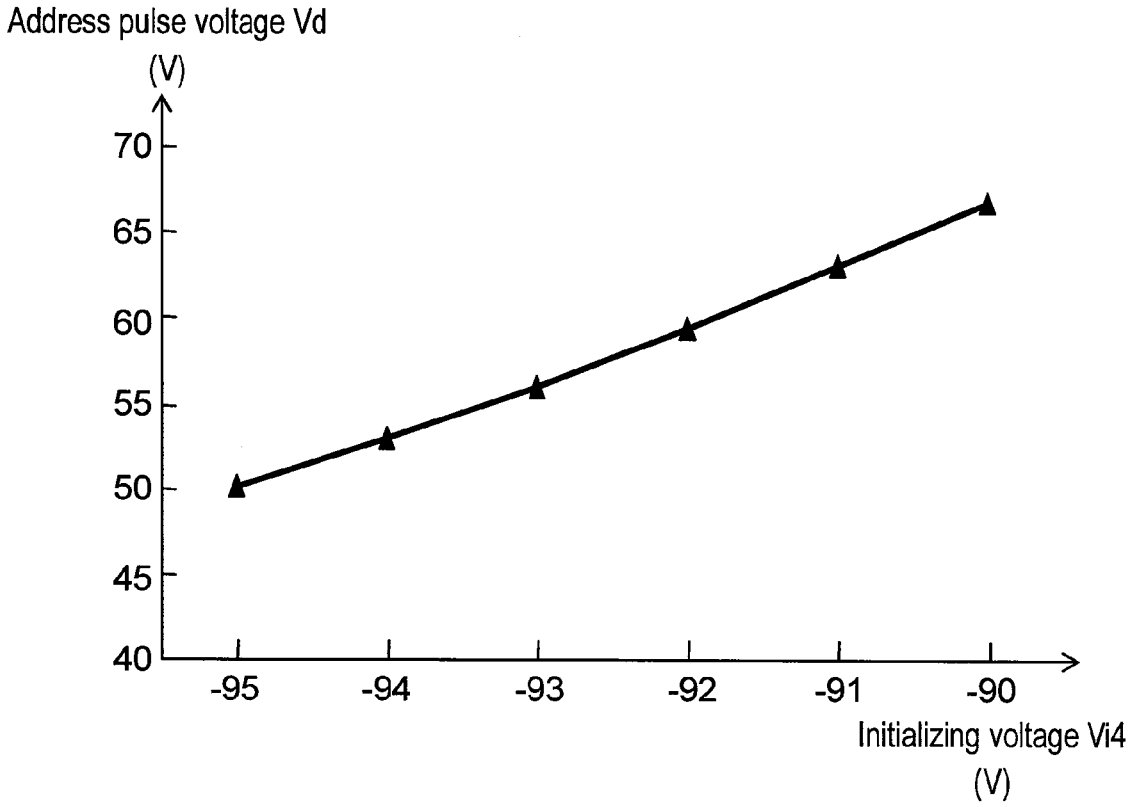
FIG. 10 is a diagram showing the relation between initializing voltage Vi4 and address pulse voltage Vd necessary for generating a stable address discharge in a preferred embodiment of the present invention.

FIG. 10 is a diagram showing the relation between initializing voltage Vi4 and address pulse voltage Vd necessary for generating a stable address discharge in a preferred embodiment of the present invention. In FIG. 10, the axis of ordinates represents address pulse voltage Vd necessary for generating a stable address discharge, and the axis of abscissas denotes initializing voltage Vi4.

As shown in FIG. 10, depending on the voltage of initializing voltage Vi4, address pulse voltage Vd necessary for generating a stable address discharge varies, but contrary to the case of scan pulse voltage, when initializing voltage Vi4 is increased, address pulse voltage Vd necessary for generating a stable address discharge is also increased. For example, when initializing voltage Vi4 is about −95 V, necessary address pulse voltage Vd is about 50 V, or when initializing voltage Vi4 is about −90 V, necessary address pulse voltage Vd is about 66 V, that is, about 16 V higher.

The margin of address pulse voltage (the difference between address pulse voltage necessary for generating a discharge, and address pulse voltage Vd applied actually to data electrode D1 to data electrode Dm) is related to the generation amount of charge loss, and when the margin is smaller, it is known that the charge loss is worsened. That is, when address pulse voltage Vd necessary for generating a address discharge is increased, the charge loss is worsened, and possibility of occurrence of unlit cells is higher.

Herein, in the second sub-field group (the seventh SF to the tenth SF) using the second coding, occurrence of unlit cells due to decrease in wall voltage is substantially zero. This is because, in the second sub-field group, if charge loss causing unlit discharge cell may occur in any one of the sub-fields, such discharge cell is not used for light emission in the subsequent sub-fields.

That is, in the second sub-field group (the seventh SF to the tenth SF) using the second coding, by setting initializing voltage Vi4 to Vi4H, if the margin of address pulse voltage becomes narrow, occurrence of unlit cell is substantially zero, and there is no problem.

In the present preferred embodiment, as shown in FIG. 7, in the first sub-field group (the first SF to the sixth SF) using the first coding, initializing voltage Vi4 is set to Vi4L, and a down-ramp waveform voltage is generated, and in the second sub-field group (the seventh SF to the tenth SF) using the second coding, initializing voltage Vi4 is set to Vi4H, higher than Vi4L and a down-ramp waveform voltage is generated. As a result, occurrence of unlit cells is decreased, and a stable writing is realized without increasing the scan pulse voltage (amplitude) or address pulse voltage Vd.

In the present preferred embodiment, Vi4L is −95 V, and Vi4H is −90 V, 5 V higher than Vi4L, but these numerical values are based on the 50-inch panel of 1080 pairs of display electrodes, and the present preferred embodiment is not limited to these numerical values alone.

Figure 11:
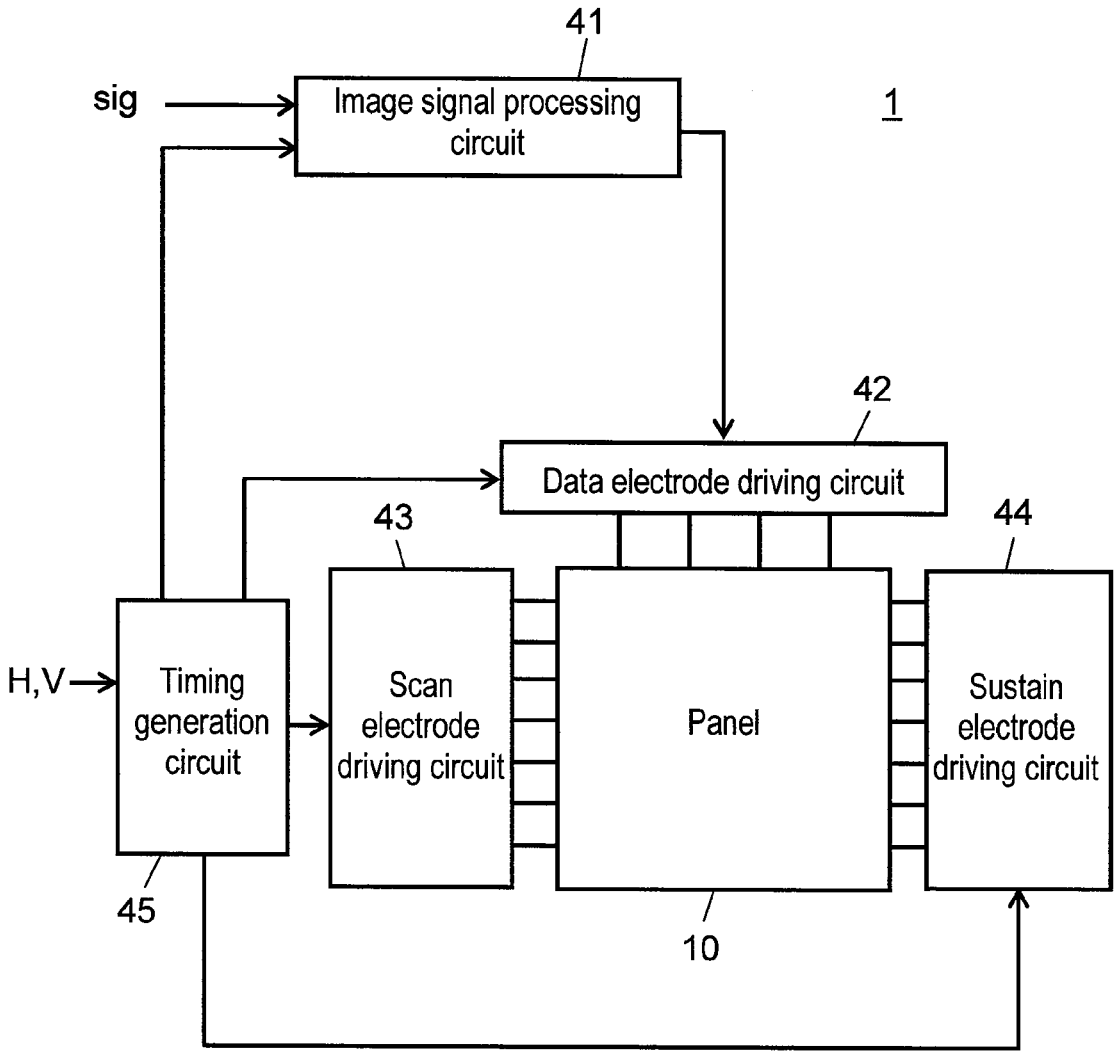
FIG. 11 is a circuit block diagram of a plasma display device in a preferred embodiment of the present invention.

The configuration of the plasma display panel device in the present preferred embodiment is explained. FIG. 11 is a circuit block diagram of a plasma display device in a preferred embodiment of the present invention. Plasma display device 1 in the present preferred embodiment includes panel 10 having a plurality of discharge cells each having a pair of display electrodes formed of a scan electrode and a sustain electrode, and a driving circuit for driving this panel 10. The driving circuit is composed of image signal processing circuit 41, data electrode driving circuit 42, scan electrode driving circuit 43, sustain electrode driving circuit 44, timing generation circuit 45, and a power source circuit (not shown) for supplying necessary power to the circuit blocks.

Image signal processing circuit 41 receives image signal sig and converts into image data showing emission or non-emission in every sub-field. Data electrode driving circuit 42 converts the image data of every sub-field into a signal corresponding to any one of data electrode D1 to data electrode Dm, and drives data electrode D1 to data electrode Dm.

Timing generation circuit 45 generates various timing signals for controlling the operation of the circuit blocks on the basis of horizontal synchronizing signal H and vertical synchronizing signal V, and supplies to each circuit block. As mentioned above, in the present preferred embodiment, in the first sub-field group (the first SF to the sixth SF) using the first coding, initializing voltage Vi4 is set to Vi4L, and a down-ramp waveform voltage is generated, and in the second sub-field group (the seventh SF to the tenth SF) using the second coding, initializing voltage Vi4 is set to Vi4H, higher than Vi4L and a down-ramp waveform voltage is generated, and each corresponding timing signal is issued to each driving circuit. As a result, occurrence of unlit cells is reduced, and the writing operation is controlled to be stable.

Scan electrode driving circuit 43 is composed of an initializing waveform generating circuit for generating an initializing waveform voltage to be applied to scan electrode SC1 to scan electrode SCn in the initializing period, a sustain pulse generation circuit for generating a sustain pulse voltage to be applied to scan electrode SC1 to scan electrode SCn in the sustain period, ad a scan pulse generation circuit for generating a scan pulse voltage to be applied to scan electrode SC1 to scan electrode SCn in the address period, and on the basis of the timing signal, scan electrode SC1 to scan electrode SCn are driven. Sustain electrode driving circuit 44 has a sustain pulse generation circuit and a circuit for generating voltage Ve1 and voltage Ve2, and sustain electrode SU1 to sustain electrode SUn are driven on the basis of the timing signal.

Figure 12:
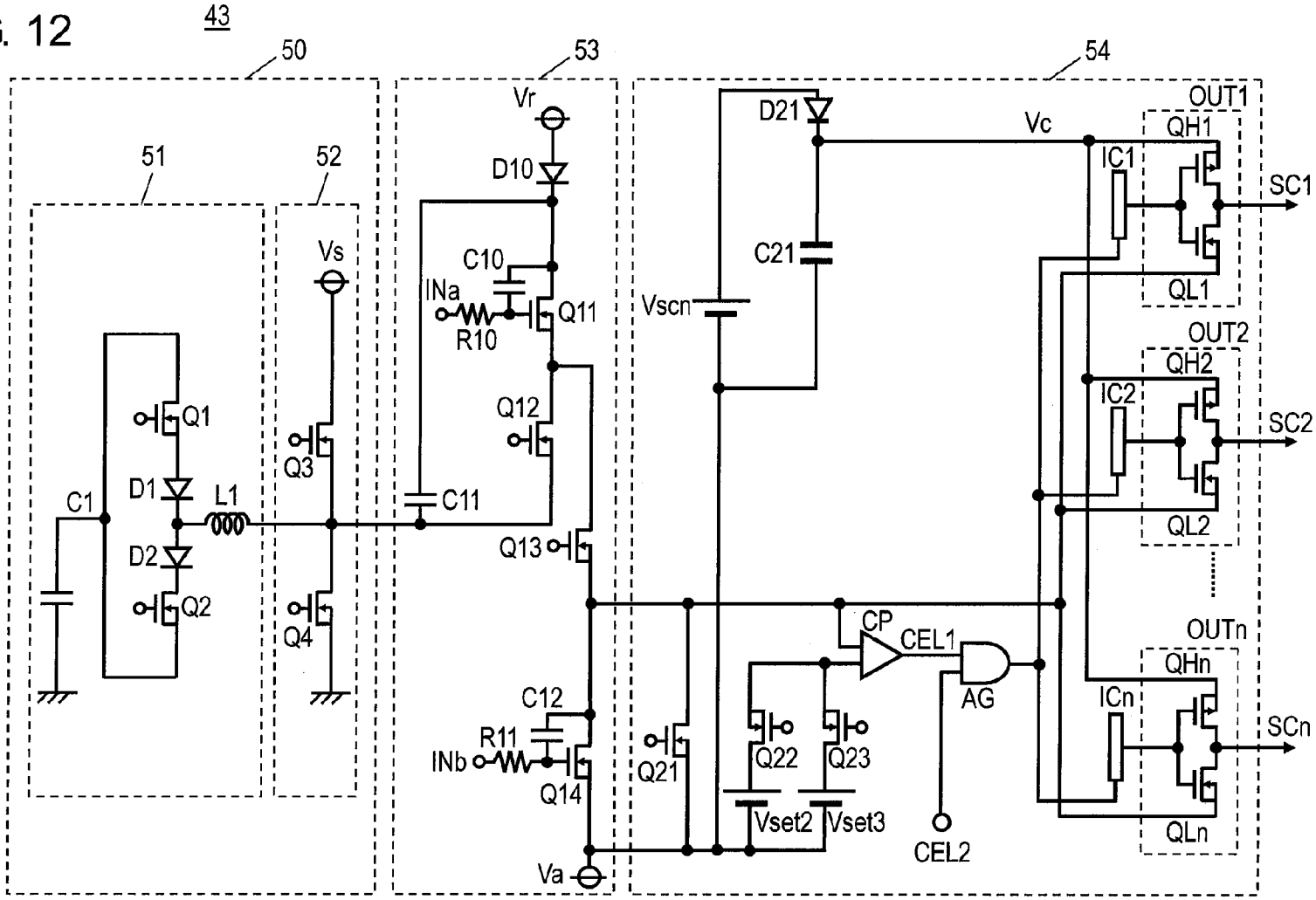
FIG. 12 is a circuit diagram of a scan electrode driving circuit in a preferred embodiment of the present invention.

The detail and operation of scan electrode driving circuit 43 are explained below. FIG. 12 is a circuit diagram of scan electrode driving circuit 43 in a preferred embodiment of the present invention. Scan electrode driving circuit 43 includes sustain pulse generation circuit 50 for generating sustain pulses, initializing waveform generation circuit 53 for generating an initializing waveform, and scan pulse generation circuit 54 for generating scan pulses.

Sustain pulse generation circuit 50 has power recovery circuit 51 and clamp circuit 52. Power recovery circuit 51 is composed of power recovery capacitor C1, switching element Q1, switching element Q2, counter-flow preventive diode D1, diode D2, and resonance inductor L1. Power recovery capacitor C1 has a capacity sufficiently larger than inter-electrode capacity Cp, and is charged at about Vs/2, half of voltage value Vs, so as to work as power source for power recovery circuit 51. Clamp circuit 52 has switching element Q3 for clamping scan electrode SC1 to scan electrode SCn at voltage Vs, and switching element Q4 for clamping scan electrode SC1 to scan electrode SCn at 0 V. Sustain pulse voltage Vs is generated on the basis of the timing signal issued from timing generation circuit 45.

For example, when raising the sustain pulse waveform, switching element Q1 is turned on, and inter-electrode capacity Cp and inductor L1 resonate with each other, and an electric power is supplied from power recovery capacitor C1 into scan electrode SC1 to scan electrode SCn by way of switching element Q1, diode D1, and inductor L1. When the voltage of scan electrode SC1 to scan electrode SCn becomes closer to Vs, switching element Q3 is turned on, and scan electrode SC1 to scan electrode SCn are clamped to voltage Vs.

When lowering the sustain pulse waveform, on the other hand, switching element Q2 is turned on, and inter-electrode capacity Cp and inductor L1 resonate with each other, and the electric power is recovered in power recovery capacitor C1 from inter-electrode capacity Cp by way of inductor L1, diode D2, and switching element Q2. When the voltage of scan electrode SC1 to scan electrode SCn becomes closer to 0 V, switching element Q4 is turned on, and scan electrode SC1 to scan electrode SCn are clamped to 0 V.

Initializing waveform generation circuit 53 is provided with a Miller integration circuit having switching element Q11, capacitor C10, and resistor R10, for generating an up-ramp waveform voltage ascending gently like a ramp up to voltage Vi2, a Miller integration circuit having switching element Q14, capacitor C12, and resistor R11, for generating a down-ramp waveform voltage descending gently like a ramp down to specified initializing voltage Vi4, a separation circuit having switching element Q12, and a separation circuit having switching element Q13. On the basis of the timing signal issued from timing generation circuit 45, the specified initializing waveform is generated, and initializing voltage Vi4 in all-cell initializing operation is controlled. In FIG. 12, input terminals of the Miller integration circuits are indicated as input terminal INa and input terminal INb.

For example, when generating an up-ramp waveform voltage in initializing waveform, a specified voltage (for example, 15 V) is applied to input terminal INa, and input terminal INa is set to "Hi". As a result, a specific current flows from resistor R10 to capacitor C10, and the source voltage of switching element 11 ascends like a ramp, and the output voltage of scan electrode driving circuit 43 also begins to ascend like a ramp.

When generating a down-ramp waveform voltage in initializing waveform in all-cell initializing operation and selective initializing operation, a specified voltage (for example, 15 V) is applied to input terminal INb, and input terminal INb is set to "Hi". As a result, a specific current flows from resistor R11 to capacitor C12, and the drain voltage of switching element 14 descends like a ramp, and the output voltage of scan electrode driving circuit 43 also begins to descend like a ramp.

Scan pulse generation circuit 54 includes switch circuit OUT1 to switch circuit OUTn for issuing scan pulse voltages to scan electrode SC1 to scan electrode SCn, switching element Q21 for clamping the low voltage side of switch circuit OUT1 to switch circuit OUTn at voltage Va, control circuit IC1 to control circuit ICn for controlling switch circuit OUT1 to switch circuit OUTn, and diode D21 and capacitor C21 for applying voltage Vc having voltage Vscn superposed on voltage Va to the high voltage side of switch circuit OUT1 to switch circuit OUTn. Each one of switch circuit OUT1 to switch circuit OUTn has switching element QH1 to switching element QHn for issuing voltage Vc, and switching element QL1 to switching element QLn for issuing voltage Va. On the basis of the timing signal issued from timing signal generation circuit 45, scan pulse voltages Va to be applied to scan electrode SC1 to scan electrode SCn are sequentially generated in the address period. Scan pulse generation circuit 54 directly issues the voltage waveform from initializing waveform generation circuit 53 in the initializing period, and the voltage waveform from sustain pulse generation circuit 50 in the sustain period.

Herein, a very large current flows in switching element Q3, switching element Q4, switching element Q12, and switching element Q13, and these switching elements are provided with plural rows of FET, IGBT or the like, and the impedance is lowered.

Scan pulse generation circuit 54 also has AND gate AG for calculating the logical product, comparator CP for comparing the magnitude of input signals entered in two input terminals, and also switching element Q22 and switching element Q23. Comparator CP compares a driving waveform voltage with superposed voltage (Va+Vset2) of voltage Va and voltage Vset2 when switching element Q22 is turned on, or with superposed voltage (Va+Vset3) of voltage Va and voltage Vset3 when switching element Q23 is turned on, and issues "0" when the driving waveform voltage is higher, and issues "1" otherwise. AND gate AG receiving two input signals, that is, output signal (CEL1) and changeover signal CEL2 of comparator CP. For changeover of switching element Q22 and switching element Q23, and changeover signal CEL2, the timing signal generated from timing signal generation circuit 55 can be used. AND gate AG issues "1" when both input signals are "1", and issues "0" otherwise. The output of AND gate AG is put into control circuit IC1 to control circuit ICn, and when the output of AND gate AG is "0", the driving waveform voltage is issued through switching element QL1 to switching element QLn, and when the output of AND gate AG is "1", voltage Vscn is superposed on voltage Va through switching element QH1 to switching element QHn, and voltage Vc is issued.

Although not shown in the drawing, the sustain pulse generation circuit in sustain electrode driving circuit 44 is same in structure as sustain pulse generation circuit 50, and includes a power recovery circuit for recovering and reusing the power when driving sustain electrode SU1 to sustain electrode SUn, a switching element for clamping sustain electrode SU1 to sustain electrode SUn at voltage Vs, and a switching element for clamping sustain electrode SU1 to sustain electrode SUn at 0 V, and thereby a sustain pulse voltage Vs is generated.

In the present preferred embodiment, initializing waveform generation circuit 53 includes a Miller integration circuit having a FET relatively simple in structure, but not limited to this structure, and any other circuit may be used as far as capable of generating an up-ramp waveform voltage and a down-ramp waveform voltage.

Figure 13:
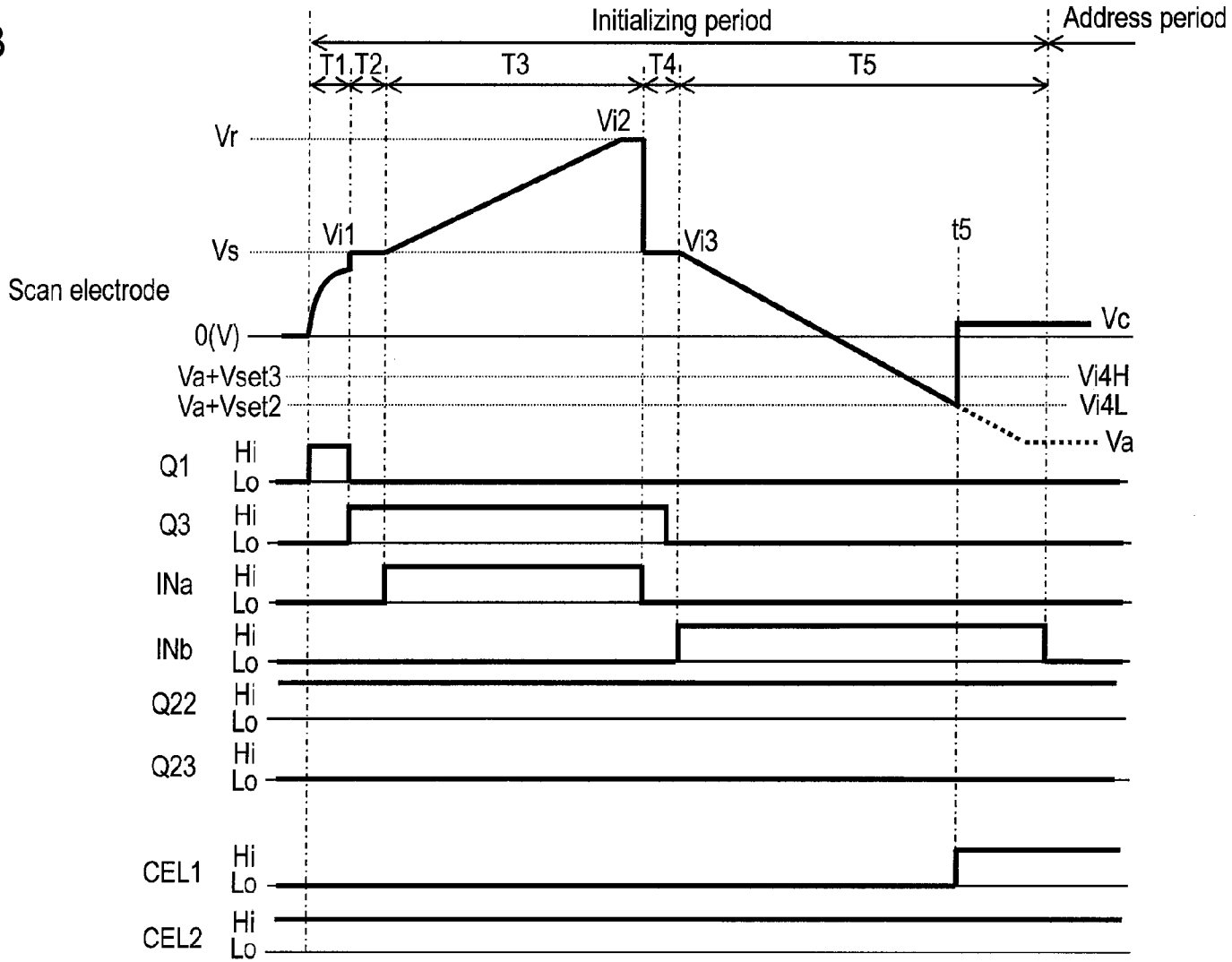
FIG. 13 is a timing chart for explaining an example of operation of scan electrode driving circuit in all-cell initializing period in a preferred embodiment of the present invention.
Figure 14:
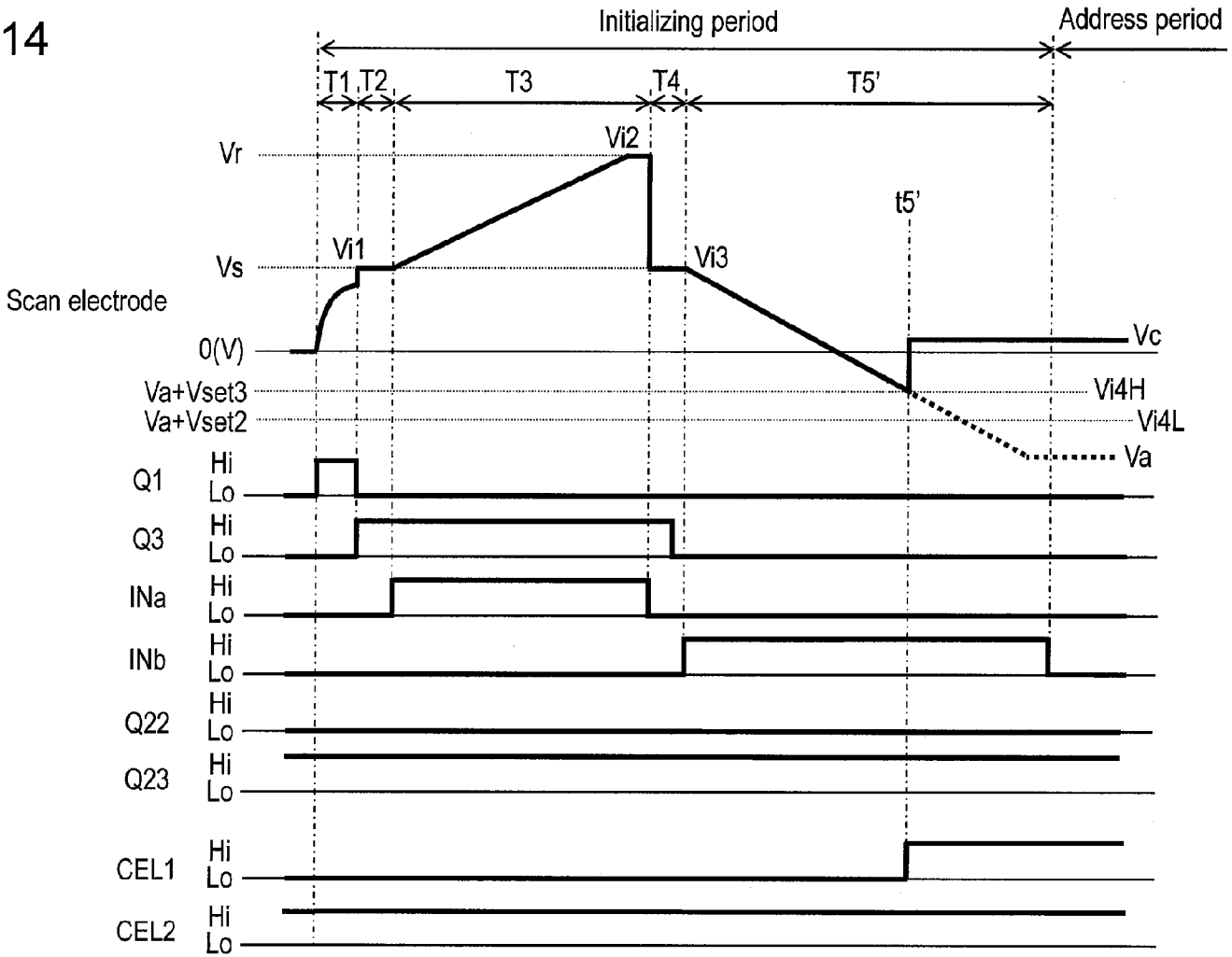
FIG. 14 is a timing chart for explaining other example of operation of scan electrode driving circuit in all-cell initializing period in a preferred embodiment of the present invention.

The operation of initializing waveform generation circuit 53 and the control method of initializing voltage Vi4 are explained below by referring to the drawing. The operation of setting initializing voltage Vi4 to Vi4L is explained in FIG. 13, and the operation of setting initializing voltage Vi4 to Vi4H is explained in FIG. 14. In FIG. 13 and FIG. 14, the control method of initializing voltage Vi4 is explained by referring to examples of driving waveform in all-cell initializing operation, but also in selective initializing operation, initializing voltage Vi4 can be controlled by the same method.

In FIG. 13 and FIG. 14, the driving voltage waveform of all-cell initializing operation is divided into five periods, period T1 to period T5, and each period is specifically described below. Voltage Vi1, voltage Vi3, voltage Vi3' are supposed to be equal to voltage Vs, voltage Vi2 is supposed to be equal to voltage Vr, voltage Vi4L is supposed to be equal to superposed voltage (Va+Vset2) of negative voltage Va and voltage Vset2, and voltage Vi4H is supposed to be equal to superposed voltage (Va+Vset3) of negative voltage Va and voltage Vset3. In the following explanation, the operation for turning on the switching element is ON and the operation for shutting off is OFF. In the drawing, the signal for turning on the switching element is shown as "Hi", and the signal for turning off is "Lo", and input signals CEL1 and CEL2 to AND gate AG are similarly shown as "1" for "Hi", and "0" for "Lo".

FIG. 13 is a timing chart for explaining an example of operation of scan electrode driving circuit 43 in all-cell initializing period in a preferred embodiment of the present invention. Herein, to set initializing voltage Vi4 to Vi4L, in period T1 to period T5, switching element Q22 is maintained in ON state and switching element Q23 is maintained in OFF state, and changeover signal CEL2 is 1.

(Period T1)

Switching element Q1 of sustain pulse generation circuit 50 is turned on. As a result, inter-electrode capacity Cp and inductor L1 resonate with each other, and the voltage of scan electrode SC1 to scan electrode SCn begins to elevate from power recovery capacitor C1 by way of switching element Q1, diode D1, and inductor L1.

(Period T2)

Switching element Q3 of sustain pulse generation circuit 50 is turned on. As a result, voltage Vs is applied to scan electrode SC1 to scan electrode SCn by way of switching element Q3, and the potential of scan electrode SC1 to scan electrode SCn becomes equal to voltage Vs (equal to voltage Vi1 in the present preferred embodiment).

(Period T3)

Input terminal INa of the Miller integration circuit for generating an up-ramp waveform voltage is set to "Hi". Specifically, voltage 15 V is applied to input terminal INa. As a result, a constant current begins to flow from resistor R10 to capacitor C10, and the source voltage of switching element Q11 begins to ascent like a ramp, and the output voltage of scan electrode driving circuit 43 also begins to ascend like a ramp. This voltage elevation continues for the duration of input terminal INa being "Hi".

When the output voltage climbs up to voltage Vr (equal to voltage Vi2 in the present preferred embodiment), subsequently, input terminal INa is set to "Lo". Specifically, for example, voltage 0 v is applied to input terminal INa.

In this manner, an up-ramp waveform voltage ascending gently from voltage Vs less than discharge start voltage (equal to voltage Vi1 in the present preferred embodiment) to voltage Vr more than discharge start voltage (equal to voltage Vi2 in the present preferred embodiment) is applied to scan electrode SC1 to scan electrode SCn.

(Period T4)

When input terminal INa is set to "Low", the voltage of scan electrode SC1 to scan electrode SCn drops to voltage Vs (equal to voltage Vi3 in the present preferred embodiment). Then, switching element Q3 is turned off.

(Period T5)

Input terminal INb of the Miller integration circuit for generating a down-ramp waveform voltage is set to "Hi". Specifically, voltage 15 V is applied to input terminal INb. As a result, a constant current begins to flow from resistor R11 to capacitor C12, and the drain voltage of switching element Q14 begins to descend like a ramp, and the output voltage of scan electrode driving circuit 43 also begins to descend like a ramp. Just before termination of the initializing period, input terminal INb is set to "Lo". Specifically, for example, voltage 0 v is applied to input terminal INb.

At this time, in comparator CP, since switching element Q22 is held in ON, and switching element Q23 is held in OFF, this down-ramp waveform voltage is compared with summed voltage (Va+Vset2) of voltage Va and voltage Vset2, and output signal CEL1 from comparator CP is changed over from "0" to "1" at time t5 when the down-ramp waveform voltage becomes lower than voltage (Va+Vset2). Since changeover signal CEL2 is "1", the input of AND gate AG is also "1", and "1" is issued from AND gate AG, and scan pulse generation circuit 54 issues superposed voltage Vc of negative voltage Va and voltage Vscn. Therefore, scan pulse generation circuit 54 issues initializing voltage Vi4 (Va+Vset2), that is, a down-ramp waveform voltage lowered to Vi4L.

Thus, scan electrode driving circuit 43 applies an up-ramp waveform voltage ascending gently from voltage Vi1 below the discharge start voltage toward voltage Vi2 above the discharge start voltage to scan electrode SC1 to scan electrode SCn, and then applies a down-ramp waveform voltage descending gently from voltage Vi3 toward initializing voltage Vi4 (herein, Vi4L).

Although not shown in the drawing, after the initializing period, in the subsequent address period, switching element Q21 is kept in ON state. As a result, the voltage applied to one terminal of comparator CP is a negative voltage Va, and output signal CELL from comparator CP is held in "1". As a result, the output from AND gate AG is held in "1", and scan pulse generation circuit 54 issues superposed voltage Vc of negative voltage Va and voltage Vscn. Although not shown in the drawing, at the timing of generating a negative scan pulse voltage, by setting changeover signal CEL2 to "0", the output signal of AND gate AG becomes "0", and scan pulse generation circuit 54 issues negative voltage Va. Thus, a negative scan pulse voltage in the address period can be generated.

Referring now to FIG. 14, the operation for setting initializing voltage Vi4 to Vi4H is explained. FIG. 14 is a timing chart for explaining other example of operation of scan electrode driving circuit 43 in all-cell initializing period in a preferred embodiment of the present invention. Herein, for setting initializing voltage Vi4 to Vi4H, in period T1 to period T5', switching element Q22 is kept OFF, and switching element Q23 is kept ON. In FIG. 14, the operation in period T1 to period T4 is same as the operation in period T1 to period T4 shown in FIG. 13, and only period T5' is explained herein because it is different from period T5 shown in FIG. 13.

(Period T5')

In period T5', input terminal INb of the Miller integration circuit for generating a down-ramp waveform voltage is set to "Hi". Specifically, voltage 15 V is applied to input terminal INb. As a result, a constant current begins to flow from resistor R11 to capacitor C12, and the drain voltage of switching element Q14 begins to descend like a ramp, and the output voltage of scan electrode driving circuit 43 also begins to descend like a ramp.

At this time, in comparator CP, since switching element Q22 is held in OFF, and switching element Q23 is held in ON, this down-ramp waveform voltage is compared with superposed voltage (Va+Vset3) of voltage Va and voltage Vset3, and output signal CEL1 from comparator CP is changed over from "0" to "1" at time t5' when the down-ramp waveform voltage becomes lower than voltage (Va +Vset3). Since changeover signal CEL2 at this time is "1", the intput of AND gate AG is also "1", and "1" is issued from AND gate AG. As a result, scan pulse generation circuit 54 issues superposed voltage Vc of negative voltage Va and voltage Vscn. Therefore, the lowest voltage of the down-ramp waveform voltage is (Va+Vset3), that is, Vi4H.

Herein, since switch circuit OUT1 to switch circuit OUTn are designed to be changed over depending on the comparison result by comparator CP, in FIG. 13 and FIG. 14, the waveform shows that the down-ramp waveform voltage Vi4L is immediately changed over to Vc right after down-ramp waveform voltage reaches Vi4L or Vi4H, but the present preferred embodiment is not limited to such waveform, and the voltage may be maintained for a specific period after reaching Vi4L or Vi4H.

In the present preferred embodiment, scan electrode driving circuit 43 is composed as shown in FIG. 12, and only by setting Vset2 and Vset3 at desired voltage values, it is possible to control easily the lowest voltage of down-ramp waveform voltage descending gently, that is, the voltage value of initializing voltage Vi4.

The present preferred embodiment relates mainly to control of initializing voltage Vi4 in all-cell initializing operation, but in selective initializing operation, it is only different in that the up-ramp waveform voltage is not generated, but it is the same about generation of down-ramp voltage waveform, and initialing voltage Vi4 may be controlled similarly.

To change initialing voltage Vi4, various other methods are possible aside from the method mentioned above. It is possible, for example, to raise or lower voltage Vi4 by controlling the descending inclination from voltage Vi3 to voltage Vi4. In the present preferred embodiment, the changing method of initializing voltage Vi4 is not particularly specified, but other method may be similarly applied.

In the present preferred embodiment, Vset2 is 5 V and Vset3 is 10 V, and Vi4H is set higher than Vi4L by 5V, but the voltage is not particularly specified. Preferably it is set at an appropriate value depending on the panel characteristic or the specification of the plasma display device.

As explained herein, in the present preferred embodiment, one field is divided into two sub-fields, that is, a first sub-field group composed of two or more continuous sub-fields including smallest luminance weight (in the present preferred embodiment, the first SF to the sixth SF) and a second sub-field group composed of two or more continuous sub-fields including largest luminance weight (in the present preferred embodiment, the seventh SF to the tenth SF), and the first sub-field group controls the writing on the basis of the first coding, and the second sub-field group controls the writing on the basis of the second coding. Initializing voltage Vi4 of down-ramp waveform voltage is changed over between Vi4L and Vi4H higher than Vi4L, and in the initializing period of the second sub-field group, initializing voltage Vi4 is set at Vi4H, higher than the voltage of Vi4L in the initializing period in the first sub-field group. In such configuration, unlit cell are decreased, and a stable writing is realized without increasing the scan pulse voltage (amplitude) and address pulse voltage Vd.

Figure 16:
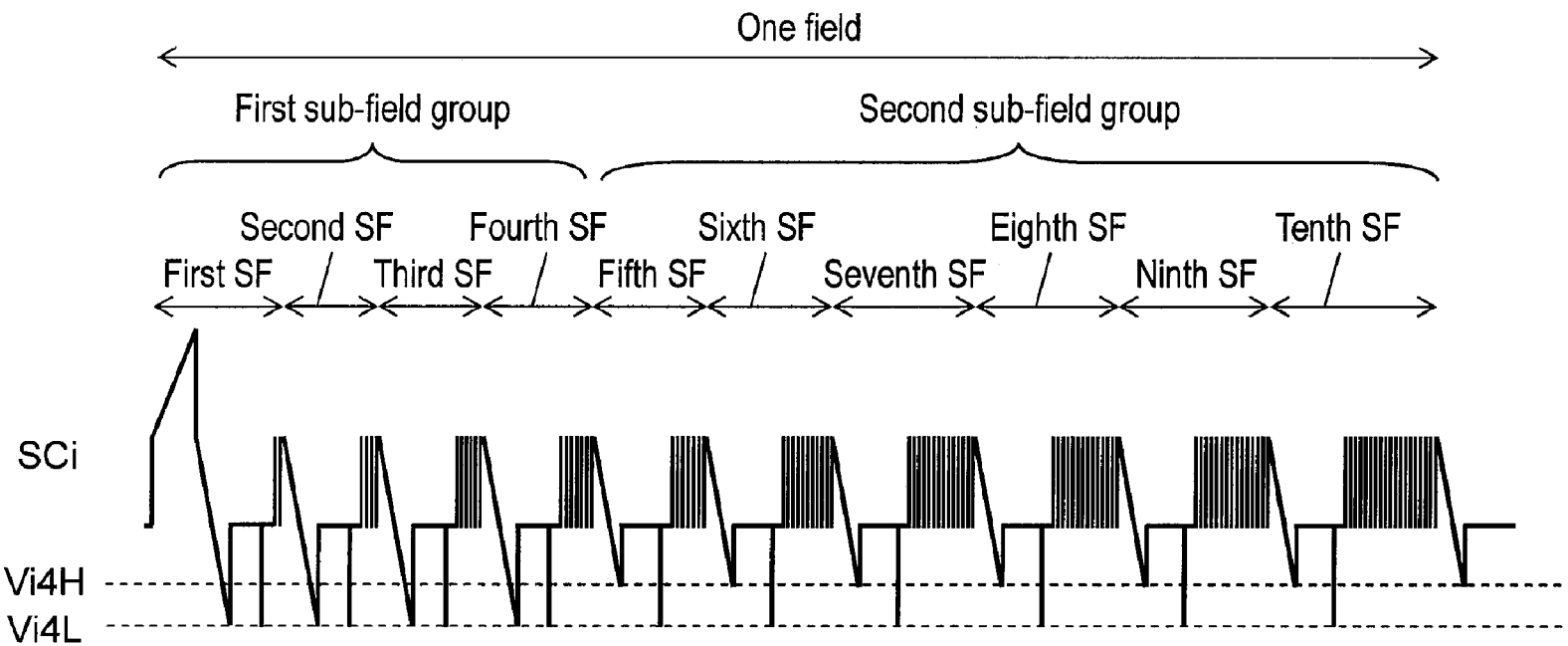
FIG. 16 is a diagram showing other example of driving voltage waveform to be applied to a scan electrode in a preferred embodiment of the present invention.

As explained in the present preferred embodiment, the firs sub-field group is composed of first SF to sixth SF, and the second sub-field group is composed of seventh SF and tenth SF, but the present invention is not limited to this configuration alone, but the sub-fields may be composed otherwise. FIG. 15A and FIG. 15B show other examples of coding in the preferred embodiment of the present invention, and FIG. 16 shows other example of driving voltage waveform to be applied to the scan electrodes in a preferred embodiment of the present invention. FIG. 15A is a diagram showing other example of coding from gray scale value 0 to gray scale value 76, and FIG. 15B is a diagram showing another example of coding from gray scale value 77 to gray scale value 256. For example, first SF to fourth SF may be gathered as first sub-field group, and fifth SF to tenth SF maybe gathered as second sub-field group, and in this case, therefore, the coding is as shown in FIG. 15A and FIG. 15B. In this case, as shown in FIG. 16, in the initializing period of first sub-field group (first SF to fourth SF) for controlling emission and non-emission by the first coding, initializing voltage Vi4 is set to Vi4L, and a down-ramp waveform voltage is generated for initializing, and in the initializing period of second sub-field group (fifth SF to tenth SF) for controlling emission and non-emission by the second coding, initializing voltage Vi4 is set to Vi4H, higher than Vi4L, and a down-ramp waveform voltage is generated for initializing. The values of Vi4L and Vi4H are not specified to these examples alone, but may be set properly depending on the panel characteristics or the specification of the plasma display device.

In the present preferred embodiment, the xenon partial pressure of discharge gas is 10%, but it may be set at other xenon partial pressure depending on the driving voltage of the panel.

Specific numerical values mentioned in the present preferred embodiment are only numerical examples, but may be preferably set at most preferred values depending on the panel characteristics or the specification of the plasma display device.

Industrial Applicability

The present invention presents a panel heightened in luminance by setting the lowest voltage of ramp waveform voltage descending gently to be applied to a scan electrode in an initializing period, at different voltage values between a first sub-field group and a second sub-field group, and therefore a stable address discharge can be generated without increasing the applied voltage necessary for generating a writing discharge, and the image display quality is enhanced while decreasing the occurrence of unlit cells, so that the invention is useful as plasma display device and panel driving method.

The invention claimed is:

1. A plasma display device comprising:

a plasma display panel having a plurality of discharge cells, each of the discharge cells having a display electrode pair formed of a scan electrode and a sustain electrode; and a driving circuit for driving the plasma display panel having a plurality of sub-fields provided in one field, each of the sub-fields having:

an initializing period for initializing the discharge cell by applying a gently descending ramp waveform voltage to the scan electrode;

an address period for addressing selectively the discharge cells to be discharged; and a sustain period for causing sustain discharge by a number of times corresponding to a luminance weight in the discharge cells performing the address discharge in the address period, wherein the driving circuit drives the plasma display panel so as to have (i) a first sub-field group including a number of the plurality of sub-fields and (ii) a second sub-field group including another number of the plurality of sub-fields in one field, and each sub-field of the second sub-field group has a luminance weight which is greater than each of the luminance weights of the first sub-field group, wherein the driving circuit drives the plasma display panel so as not to use gray scale values having two or more continuous non-emitting sub-fields positioned between a sub-field having a largest emitting luminance weight and a first sub-field in the first sub-field group, and wherein the driving circuit drives the plasma display panel by controlling the address period so as not to generate the sustain discharge in the discharge cell not causing sustain discharge and also in a subsequent sub-fields in the second sub-field, wherein the driving circuit drives the plasma display panel in such a manner that a lowest voltage of the descending ramp waveform voltage of each sub-field included in the second sub-field group is made to be higher than a lowest voltage of the descending ramp waveform voltage of each sub-field included in the first sub-field group.

2. A driving method of a plasma display panel for driving a plasma display panel having a plurality of discharge cells, each of the discharge cells having a display electrode pair formed of a scan electrode and a sustain electrode, the method comprising:

driving the panel having a plurality of sub-fields provided in one field, each of the sub-fields having:

an initializing period for initializing the discharge cells by applying a gently descending ramp waveform voltage to the scan electrode;

an address period for addressing selectively the discharge cells to be discharged; and a sustain period for causing sustain discharges by a number of times corresponding to a luminance weight in the selected discharge cells performing the address discharge in the address period;

driving the plasma display panel so as to have: (i) a first sub-field group including a number of the plurality of sub-fields, and (ii) a second sub-field group including another number of the plurality of sub-fields in one field, and each sub-field of the second sub-field group has a luminance weight which is greater than each of the luminance weights of the first sub-field group;

driving the plasma display panel so as not to use gray scale values having two or more continuous non-emitting sub-fields positioned between a subfield having a largest emitting luminance weight and a first sub-field in the first sub-field group; and driving the plasma display panel in such a manner that a lowest voltage of the descending ramp waveform voltage of each sub-field included in the second sub-field group is made to be higher than a lowest voltage of the descending ramp waveform voltage of each sub-field included in the first sub-field group.

* * * * *

UNITED STATES PATENT AND TRADEMARK OFFICE

CERTIFICATE OF CORRECTION

PATENT NO. : 8,294,635 B2
APPLICATION NO. : 12/443828
DATED : October 23, 2012
INVENTOR(S) : Takahiko Origuchi et al.

It is certified that error appears in the above-identified patent and that said Letters Patent is hereby corrected as shown below:

On the Cover Page, FIELD [56], References Cited, FOREIGN PATENT DOCUMENTS, delete "CN 2010090600421910 09/2010" and enter -- Chinese Office Action for 2010090600421910 09/2010 --, delete "EP 08 70 3033 12/2009" and enter -- Supplementary European Search Report for Application No. EP 08 70 3033 12/2009 --, On Page 2, FOREIGN PATENT DOCUMENTS, delete "KR 10-2009-7013838 12/2010" and enter -- South Korean Office Action for Application No. 10-2009-7013838 12/2010 --, delete "WO PCT/JP2008/050162 2/2008" and enter -- International Search Report for International Application No. PCT/JP2008/050162 --, delete duplicate reference "JP 2006235598A 9/2006".

Signed and Sealed this
Twenty-sixth Day of February, 2013

Teresa Stanek Rea
*Acting Director of the United States Patent and Trademark Office*